United States Patent [19]

Takano

[11] Patent Number: 4,952,987

[45] Date of Patent: Aug. 28, 1990

[54] COPYING MACHINE HAVING PLURAL DEVELOPING UNITS

[75] Inventor: Yoshiaki Takano, Osaka, Japan

[73] Assignee: Minolta Camera Kabushiki Kaisha, Osaka, Japan

[21] Appl. No.: 159,061

[22] Filed: Feb. 22, 1988

[30] Foreign Application Priority Data

| | | | |
|---|---|---|---|
| Feb. 24, 1987 | [JP] | Japan | 62-39112 |
| Feb. 24, 1987 | [JP] | Japan | 62-39113 |
| Feb. 24, 1987 | [JP] | Japan | 62-39114 |
| Feb. 24, 1987 | [JP] | Japan | 62-39115 |
| Feb. 27, 1987 | [JP] | Japan | 62-42693 |
| Feb. 27, 1987 | [JP] | Japan | 62-42694 |

[51] Int. Cl.[5] ..... G03G 21/00; G03G 15/01; G03G 15/06

[52] U.S. Cl. ..... 355/209; 355/204; 355/206; 355/245; 355/326

[58] Field of Search ..... 355/3 DD, 14 D, 14 R, 355/14 C, 203, 204, 206, 245, 326–328, 209

[56] References Cited

U.S. PATENT DOCUMENTS

| | | | |
|---|---|---|---|
| 2,910,963 | 11/1959 | Herman . | |
| 3,572,288 | 6/1968 | Turner . | |
| 3,914,043 | 10/1975 | McVeigh . | |
| 3,960,445 | 6/1976 | Drawe . | |
| 3,967,891 | 7/1976 | Rippstein . | |
| 4,099,860 | 7/1978 | Connin . | |
| 4,346,982 | 8/1982 | Nakajima et al. . | |
| 4,373,798 | 2/1983 | Tsukada et al. . | |
| 4,572,102 | 2/1986 | Yuge et al. . | |
| 4,579,443 | 4/1986 | Abuyama et al. . | |
| 4,619,514 | 10/1986 | Ide | 355/4 X |
| 4,627,707 | 12/1986 | Tani et al. . | |
| 4,634,259 | 1/1987 | Oishi et al. . | |
| 4,641,602 | 2/1987 | Kasai . | |
| 4,657,376 | 4/1987 | Ide . | |
| 4,659,211 | 4/1987 | Oka . | |
| 4,666,288 | 5/1987 | Watanabe . | |
| 4,685,794 | 8/1987 | Watanabe . | |
| 4,690,543 | 9/1987 | Watanabe . | |
| 4,710,016 | 12/1987 | Waatanabe . | |
| 4,720,730 | 1/1988 | Ito . | |
| 4,723,148 | 2/1988 | Hamakawa . | |
| 4,728,985 | 3/1988 | Nakashima et al. . | |
| 4,740,811 | 4/1988 | Watanabe . | |
| 4,743,945 | 5/1988 | Ito et al. . | |
| 4,743,946 | 5/1988 | Nishimori et al. . | |
| 4,745,437 | 5/1988 | Oka et al. . | |
| 4,746,954 | 5/1988 | Matuura et al. . | |
| 4,754,301 | 6/1988 | Kasamura et al. . | |
| 4,772,921 | 9/1988 | Ito . | |

FOREIGN PATENT DOCUMENTS

| | | |
|---|---|---|
| 3705511 | 9/1987 | Fed. Rep. of Germany . |
| 48-22212 | 7/1973 | Japan . |
| 51-134635 | 11/1976 | Japan . |
| 54-30833 | 3/1979 | Japan . |
| 56-104358 | 8/1981 | Japan . |
| 60-170868 | 9/1985 | Japan . |
| 60-212778 | 10/1985 | Japan . |
| 51-144236 | 12/1986 | Japan . |

*Primary Examiner*—Fred L. Braun
*Assistant Examiner*—Matthew S. Smith
*Attorney, Agent, or Firm*—Burns, Doane, Swecker & Mathis

[57] ABSTRACT

A copying machine provided removably with plural developing units containing different colors of toner. Control unit of the copying machine detects the loading condition of the developer and inhibits the start of copying operation when at least one developing unit is not loaded into the copying machine. The control unit further performs a quick toner supply control, a control for a request for change-over of a developing unit being supplied with toner, and a control for the indication of a residual quantity of toner. The developing unit change-over control is performed so that a developing unit drive mechanism is changed over after the developer so far used is recovered into the developing unit.

10 Claims, 29 Drawing Sheets

COPYING MACHINE HAVING PLURAL DEVELOPING UNITS

BACKGROUND OF THE INVENTION

The present invention relates to a copying machine provided detachably with a plurality of developing units which contain different colors of toners.

Recently there has been an increasing demand for color copies and in order to meet this demand there have been provided image forming apparatus which permit copying in colors in addition to black copy. In the case of a small-sized image forming apparatus, the number of developing units capable of being loaded into the apparatus is generally up to two due to a structural restriction. Color images formed using desired colors of toners can be obtained by changing developing units.

Thus, an image forming apparatus of a structure which permit easy replacement of developing units is desirable in order to obtain desired colors of images by changing developing units.

On the other hand, when an image of a color different from the colors of toners contained in the loaded developing units is to be obtained, it is possible that a developing unit which is not in use will be detached by mistake during the image forming operation of the image forming apparatus. This results in incidence of extraneous light from this portion onto the photosensitive drum and so a latent image which has been formed on the drum is erased, discharging a white copy sheet.

According to conventional methods proposed for solving this problem, a door is attached to the developing unit loading portion so that the replacement of a developing unit requires the door to be opened, or there is provided a safety device involving a switch which operates upon opening of the said door so that the image forming operation is discontinued when the door is opened to change a developing unit. As a result, however, the replacement of a developing unit becomes more troublesome.

On the other hand, if copying is made in a large volume from a high image density original using a copying machine, the toner in the developer becomes scarce, resulting in that the image density reproduced of a paper becomes lower. To avoid this inconvenience there has been developed a copying machine capable of supplying toner quickly to a developing device from a toner supply bottle upon actuation of a switch which is done by the operator when the operator judges it necessary to supply toner.

In the case of providing toner supply means for plural developing units, there occur the following problems unlike the case where only one developing unit is provided. For example, when the start of color copy is commanded during quick supply of toner to a color developing unit, it is possible to perform the copying operation under quick supply of toner without causing any special problem. On the other hand, if there is issued a copy start command for a developing unit different from the developing unit being supplied with toner, that is, in the above example, if the copying mode is changed over to a black copy mode and a copy start command is issued, the black developing unit starts operation. In this case, it is necessary to provide indicating means for indicating whether the selected developing unit is of black or color and to which developing unit the toner has been supplied. Otherwise, it would be impossible to grasp the condition, thus causing malfunction. Even if such indication is made, there still remains the possibility of malfunction based on erroneous judgement because of parallel arrangement of the indication of the selected developing unit and that of the developing unit under quick supply of toner. Further, in the color developing unit which has been supplied with toner, the developer agitating operation has also been performed simultaneously with supply of toner, but the agitation for the developer in the color developing unit is discontinued because the power transmission from the driving motor is changed over to the black developing unit. That is, carrier and toner in the developer have not been intimately mixed yet, thus affecting the image formation. Although this problem can be overcome by transmitting power to both developing units, there arises the necessity of providing a driving motor for each developing unit or providing a large-sized driving motor. Such a construction is not adoptable in small-sized apparatus.

Further, in the case of a developing unit provided with toner supply means, it is known to detect and display a decrease in the amount of toner remaining in the toner supply means to a level below a predetermined level.

For indicating the residual amount of toner in toner supply means or indicating that the toner supply means is empty, in a copying machine having plural developing units, it is the simplest method to provide a dedicated indicating element for each of the developing units. However, when these indicating elements are provided on an operating panel, a large number of indicating elements are arranged on the same panel, resulting in that the confirming operation becomes complicated. If such toner residual amount indicating elements are transferred from the upper surface of the operating panel to any other portion of the apparatus, there arises the possibility of forgetting the confirmation of indication. Anyhow, the increase in the number of indicating elements causes increase of the cost.

In the case where only one toner residual quantity indicating element is provided for a plurality of developing units and it with -- gives indication when a desired developing unit is selected and the toner supply means attached thereto is empty, it is impossible to know that there is no toner until the selection of the developing unit.

Further, the toner supplying operation, which is performed by the replacement of a toner supply bottle or by any other suitable means, is a relatively time-consuming operation, so it has been desired to provide means capable of confirming in advance that there is no toner remaining in the bottle.

SUMMARY OF THE INVENTION

1. It is a primary object of the present invention to provide a copying machine provided detachably with a plurality of developing units which contain different colors of toners.

2. It is another object of the present invention to provide a copying machine having control means for controlling the copying operation according to loaded conditions of developing units.

3. It is a further object of the present invention to provide a copying machine having improved control means for controlling the supply of toner to a plurality of developing units and also having improved indication control means for indicating the state of toner supply to each developing unit.

4. It is a still further object of the present invention to provide improved change-over control means for the change-over of plural developing units.

5. Other objects of the present invention will become apparent from the following description and the accompanying drawings.

BRIEF DESCRIPTION OF THE DRAWINGS

FIGS. 8 to 37 are flowcharts showing control processes in the copying machine which are carried out using a microprocessor, of which;

FIG. 8 is a flowchart of a main routine;

FIG. 9 is a flowchart of a color copy selection switch processing routine;

FIG. 10 is a flowchart of a drum dry switch processing routine;

FIG. 11 is a flowchart of a quick toner supply discontinuing processing routine;

FIG. 12 is a flowchart of a color developing unit loading detection routine;

FIGS. 13 to 19 are flowcharts of drum dry processing routines;

FIGS. 20 to 24 are flowcharts of function inspection processing routines;

FIG. 25 is a flowchart of an indication flicker processing routine;

FIG. 26 is a flowchart of a selected developing unit indication processing routine; and FIGS. 27 to 37 are flowcharts of magnetic brush removing routine.

DETAILED DESCRIPTION OF THE PREFERRED EMBODIMENTS

An embodiment of the present invention will be described hereinunder. In the following embodiment the present invention was applied to a copying machines having two developing units.

Figure 1:
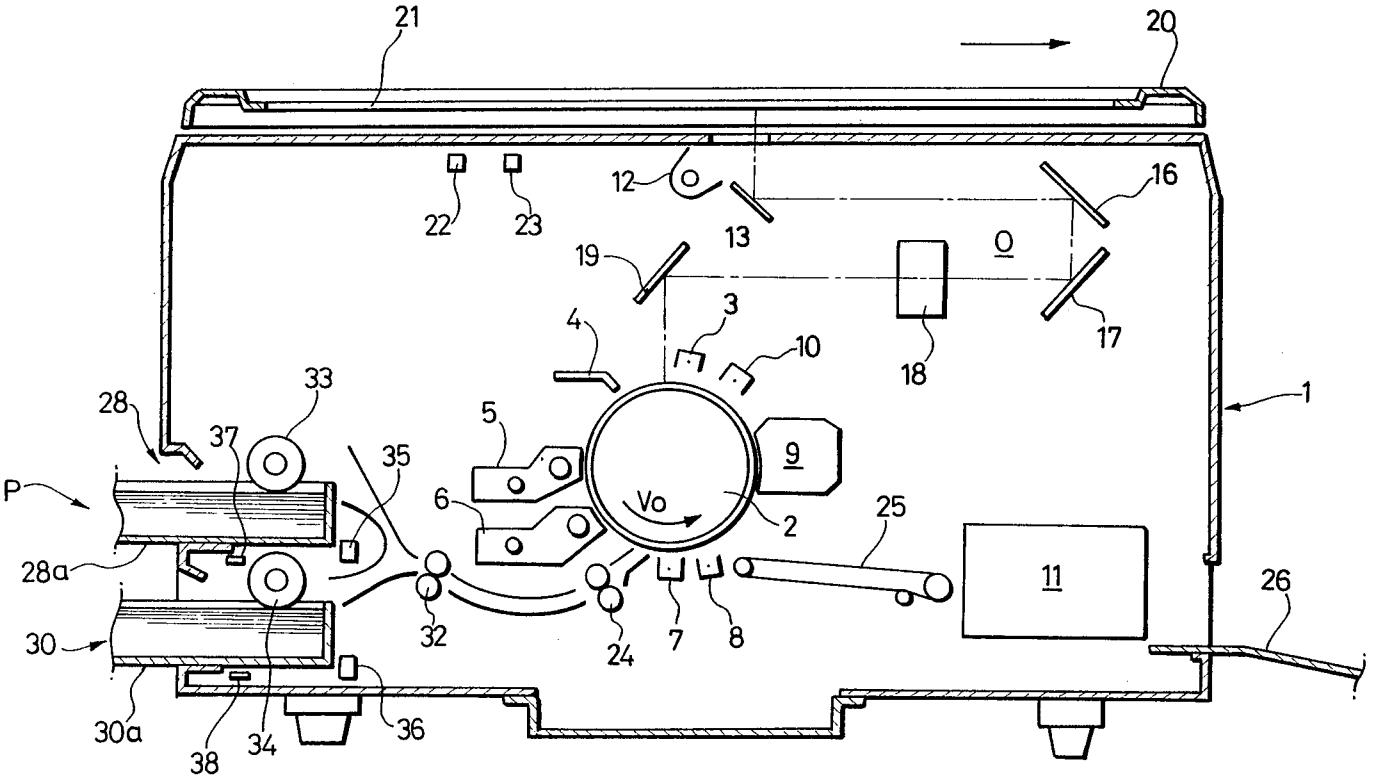
FIG. 1 is a sectional view showing a principal construction of a copying machine to which the present invention was applied.

FIG. 1 is a sectional view showing a principal construction of the copying machine, in which the numerals 1 and 2 denote the copying machine and a photosensitive drum, respectively. The photosensitive drum 2 can be rotated in a counterclockwise direction by means of a main motor (not shown). Around the photosensitive drum 2 are disposed, successively at intervals in the rotating direction of the drum, a main charger 3, an interimage eraser 4, first and second developing units 5 and 6, a transfer charger 7, a separation charger 8, a cleaner 9, and a main eraser 10. Above the photosensitive drum 2 and the devices disposed therearound is provided an optical system 0, while on the left and right-hand sides there are provided a paper feed system P and a fixing unit 11, respectively. Three or more developing units may be provided.

The optical system 0 is composed of a slit exposure type light source 12, a first mirror 13, second and third mirrors 16 and 17, a lens 18 and a fourth mirror 19.

Numerals 20 and 21 denote a movable document table and a document glass, respectively. The document table 20 is once moved to a scan start position and then in the direction of arrow in the figure by means of a scanning motor (not shown) which is driven in response to a scan command signal. In this scanning process the original image on the document glass 21 is focused on the photosensitive drum through the optical system 0 to form an electrostatic latent image. If the peripheral speed of the photosensitive drum 2 is $V_0$ and the copying magnification is m, the moving speed V of the document table 20 is set at $V=V_0/m$. The document table 20 is in pressure contact with a reference position switch 22 normally, that is, when it is in the scan start position, to provide a reference position signal to a first CPU 200. Then, in order to cause synchronism between the document table 20 and the paper feed system P, when the document table 20 has moved a predetermined distance rightwards after the start of scan, the document table comes into pressure contact with a timing switch 23 to provide a timing signal to the first CPU 200 to actuate a later-described timing roller 24.

On the surface of the photosensitive drum 2 is adhered negatively charged toner which is fed from the selectively-employed first or second developing unit 5 or 6. By this toner the foregoing electrostatic latent image is developed to form a toner image corresponding to the original image. Subsequently, the toner image is transferred by the transfer charger 7 onto a copying paper (not shown) which is fed to the surface of the photosensitive drum 2 in synchronism with the above timing signal from timing rollers 24 which are located in the most downstream position of the paper feed system P. And the paper having toner thus transferred is separated from the surface of the photosensitive drum 2 by the separation charger 8. The paper thus separated from the photosensitive drum 2 is conveyed to the fixing unit 11 by means of a conveyor belt 25, in which the toner image is heat-fixed. Then, the paper is discharged onto a tray 26.

The toner remaining on the surface of the photosensitive drum 2 is removed by the cleaner 9 and recovered into the cleaner, and the electric charge remaining on the drum surface is removed by the main eraser 10 which is kept lit during the operation of the main motor.

The paper feed system P has a first cassette paper feed portion 28 (hereinafter referred to simply as the "first paper feed portion 28") and a second cassette paper feed portion 30 (hereinafter referred to simply as the "second paper feed portion 30"). Copying papers in cassettes **28*a* and 30*a* loaded into the first and second paper feed portions 28 and 30 are conveyed to the timing rollers 24 through first and second feed rollers 33 and 34 and an intermediate roller 32**.

The rollers 24, 32, 33 and 34 are connected disengageably to the drive system involving the main motor. Upon turning ON of a clutch of each roller, the roller is brought into connection with the drive system and is rotated by the main motor. In the vicinity of the cassettes **28*a* and 30*a* there are disposed paper size detecting sensors 35 and 36 for detecting the size of the copying papers received in the cassettes 28*a* and 30*a*, as well as cassette empty sensors 37 and 38 for detecting that the copying papers in the cassettes 28*a* and 30*a*** have been used up.

Figure 2:
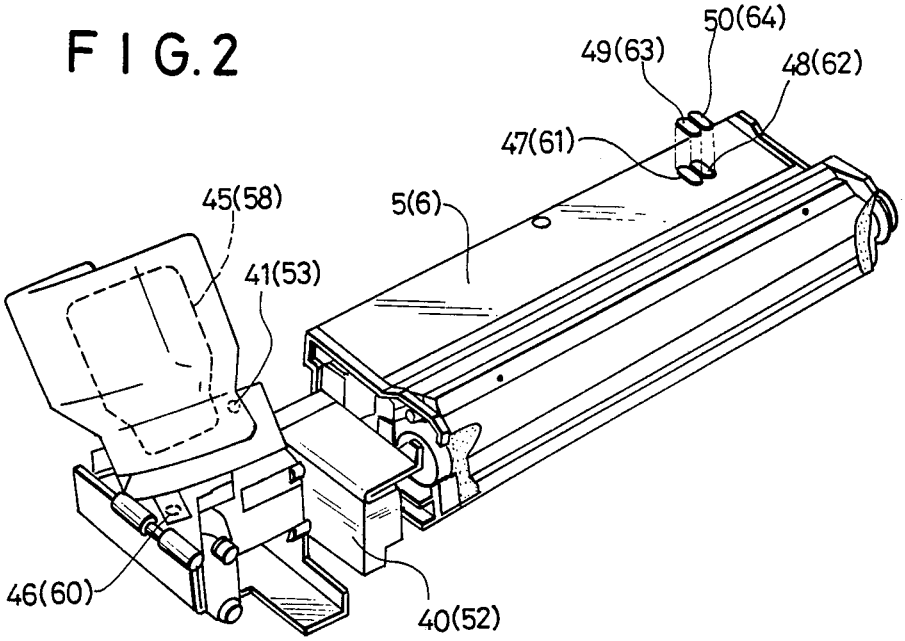
FIG. 2 is a perspective view showing an appearance of a developing unit.

The construction of the developing units will now be explained. FIG. 2 is a perspective view showing an appearance of the first developing unit 5 into which color toner is charged. The second developing unit 6 is of almost the same construction, so only the first developing unit will be explained. The parenthesized numerals in the figure are of the second developing unit. The first developing unit 5 is provided with a bracket 40 at one longitudinal end portion thereof, and a toner supply bottle 45 for supplying toner into the first developing unit 5 is attached removably to the bracket 40. The toner supply bottle 45 is rotated by a motor (not shown) to supply toner. Further, a screw for the conveyance of the supplied toner, a developing sleeve and an agitation bucket are rotated by the main motor through a drive connection mechanism (not shown). The drive connection mechanism transmits the power from the main motor to either the first developing unit 5 or the second 6.

Near the toner supply bottle 45 are disposed a toner supply bottle sensor 41 for detecting whether the toner supply bottle has been attached to the bracket or not, and a toner empty sensor 46 for detecting whether there is toner in the toner supply bottle or not.

Magnets 47 and 48 for discriminating the color of toner in the developing unit can be attached to the upper surface of the housing of the developing unit, while on the copying machine side there are provided first and second reed switches 49 and 50 for detecting the magnets 47 and 48 in positions opposed to the magnets. For example, if the two magnets 47 and 48 are mounted in the case of red toner, the first and second reed switches which have detected the magnets both turn ON, producing a discrimination signal indicative of red toner. The magnets 47 and 48 can be combined in your kinds of patterns, so it is possible to discriminate four colors of toners. The magnets are also employable for detecting a mounting condition of the first developing unit. More particularly, the toner colors to be discriminated are set up to three colors and when both the first and second reed switches are OFF it is judged that the first developing unit has been removed.

Figure 3:
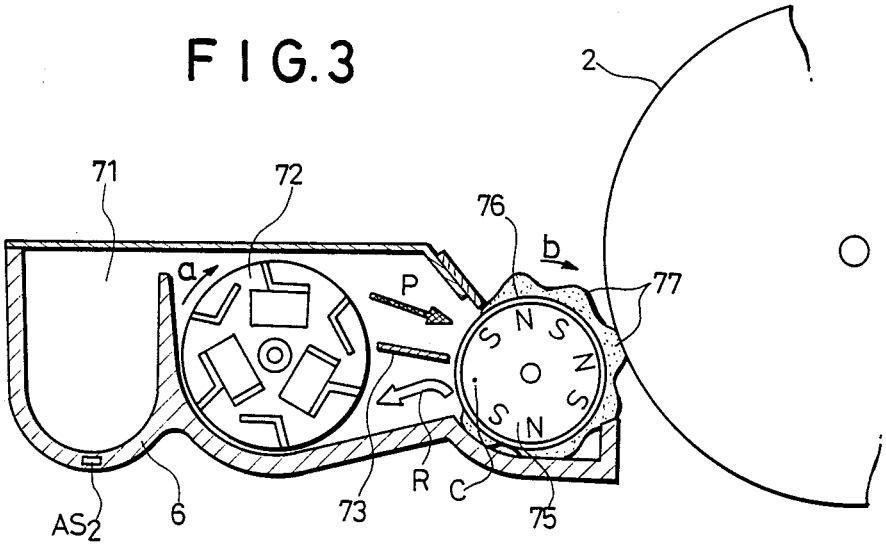
FIGS. 3 and 4 are sectional views each showing an internal construction of the developing unit.
Figure 4:
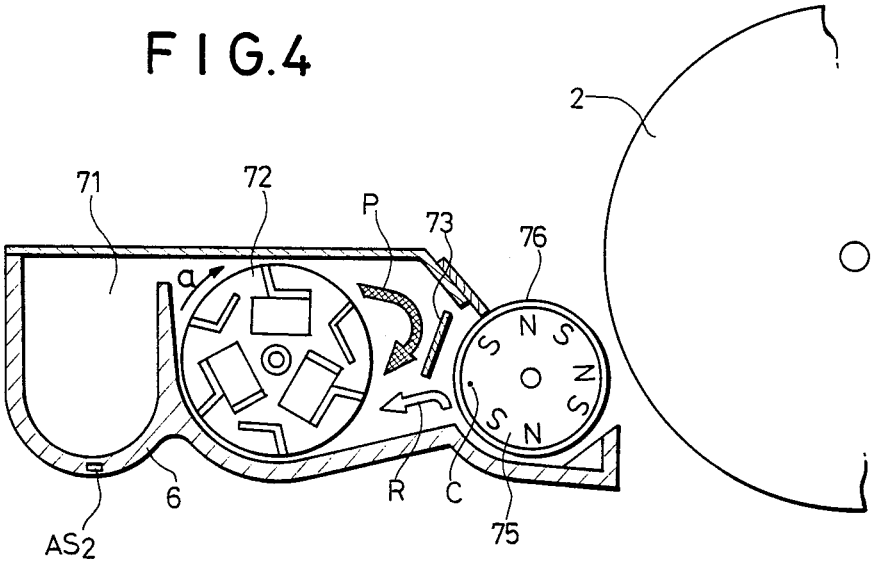

The following description is now provided about the internal construction of the developing units with reference to FIGS. 3 and 4. For the convenience of explanation, the second developing unit 6 which is charged with black toner will be explained first.

The second developing unit 6 is disposed on the downstream side in the rotating direction of the photosensitive drum with respect to the first developing unit charged with color toner.

In FIG. 3, the numeral 71 denotes a toner supply trough, through which the toner which has been supplied from the toner supply bottle 58 as previously explained is conveyed by means of a screw (not shown) or the like so that it is fed uniformly in the width direction of the photosensitive drum. Numeral 72 denotes a bucket for agitating toner and magnetic carrier and numeral 73 denotes a shutter for supplying a developer (a toner-magnetic carrier mixture) to a developing sleeve 76 or cutting off the supply.

Figure 5:
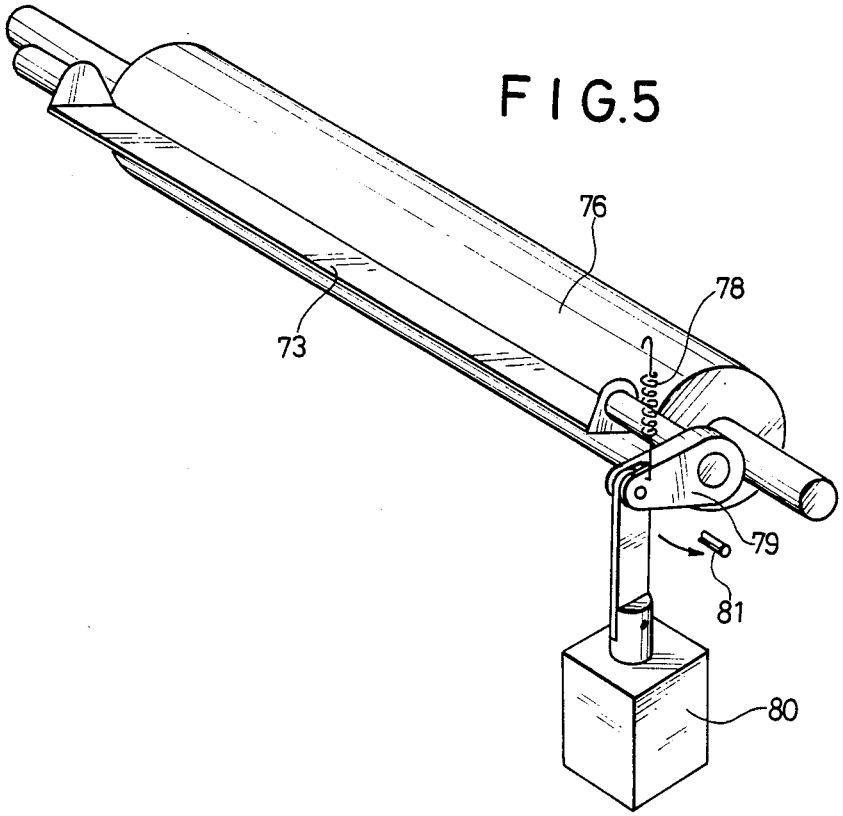
FIG. 5 is a perspective view of a shutter portion of the developing unit.

FIG. 5 is a perspective view showing the shutter portion of the developing unit. The shutter 73 is normally held in its upon position shown in FIG. 3 under the action of an arm 79 which is pulled up with a spring 78. When the second developing unit 6 is rendered inoperative and the magnetic brush removing operation is performed, a magnetic brush removing solenoid 80 is energized to pull down the arm 79 until abutment with a stopper 81, so that the shutter 73 assumes its closed position shown in FIG. 4.

Numeral 75 denotes a cylindrical magnet (hereinafter referred to as the "magnet") with seven poles formed in the circumferential direction, and numeral 76 denotes a developing sleeve which is fitted over the outer periphery of the magnet and which is rotated by a motor (not shown).

When the second developing unit 6 is in operation the bucket 72 and the developing sleeve 76 rotate in the directions of arrows a and b, respectively, in the figure, whereby the developer is fed in the direction of arrow P in the figure from the bucket 72 to the developing sleeve 76 through the upper surface of the shutter 73. The developer thus fed onto the developing sleeve 76 is conveyed in the direction of arrow b with the rotation of the developing sleeve. Upon reaching the position above a pole of the magnet 75, the developer swells to form a brush 77. When the magnetic brush 77 comes into contact with the electrostatic latent image formed on the photosensitive drum 2, the toner adheres to the latent image to effect development. Thereafter, the developer is moved together with the rotation of the sleeve 76 until reaching a pole-omitted portion C, whereupon it leaves the sleeve 76, moves in the direction of arrow R in the figure and is recovered by the bucket 72.

When the second developing unit 6 is rendered inoperative, the shutter 73 assumes the closed position shown in FIG. 4, so that the developer is not fed to the developing sleeve 76 even under the rotation of the bucket 72, and the remaining developer on the sleeve 76 is moved with the rotation of the sleeve 76 and leaves the latter at the pole-omitted portion C of the magnet 75, then moves in the direction of arrow R in the figure and is recovered by the bucket 72. Now there is no developer on the developing sleeve 76. If the rotation of the sleeve 76 is stopped in this state, the upper surface of the sleeve is kept free from developer even if the magnetic brush removing solenoid is turned OFF to let the shutter 73 return to its position shown in FIG. 3.

When the developing unit is to be restored to the developable state, the developing sleeve 76 is rotated whereby the magnetic brush 77 of the developer is formed on the sleeve in an instant.

The first developing unit 5 is of the same construction as the second developing unit 6 except that a stationary guide plate is provided in the open position (see FIG. 3) of the shutter 73.

The first developing unit 5 is charged with color toner, so when color development is to be performed, the first developing unit is operated, so that the electrostatic latent image on the photosensitive drum 2 is developed by the brush formed on the developing sleeve. This is the same as in the operation of the second developing unit 6 explained previously. At this time, the second developing unit 6 is not in operation and there is no magnetic brush formed by the black developer on the sleeve, so that image which has been developed by the color toner is not disturbed. When the electrostatic latent image on the photosensitive drum 2 is to be developed by the second developing unit 6, the first developing unit 5 is rendered inoperative and the rotation of the developing sleeve is stopped. And the developing bias of the first developing unit 5 is varied to make the toner adhesion to the electrostatic latent image difficult. As a result, the toner does not adhere to the latent image even if brushes are formed on the developing sleeve by the color developer. The latent image is thereafter developed by the black developer in the second developing unit, thus providing no obstacle in practical use.

In FIGS. 3 and 4, the reference mark $AS_2$ represents a sensor (hereinafter referred to as "ATDC sensor") for detecting the toner content of the developer in the second developing unit 6. Also for the first developing unit 5 there is provided an ATDC sensor $AS_1$.

Since it is difficult to detect the toner content percentage directly during developing operation, the quantity of magnetism of the magnetic carrier is detected, from which the toner content percentage is determined. To this end, with respect to each developing unit, a developer having a predetermined content percentage of toner is charged into the developing unit and a detected level of magnetism by the ATDC sensor is used as a reference value. Thereafter, when toner is supplied, it is fully agitated together with carrier and then a detected value by the ATDC sensor is compared with the reference value to evaluate the toner content percentage.

An operating panel of the copying machine 1 will be explained below.

Figure 6:
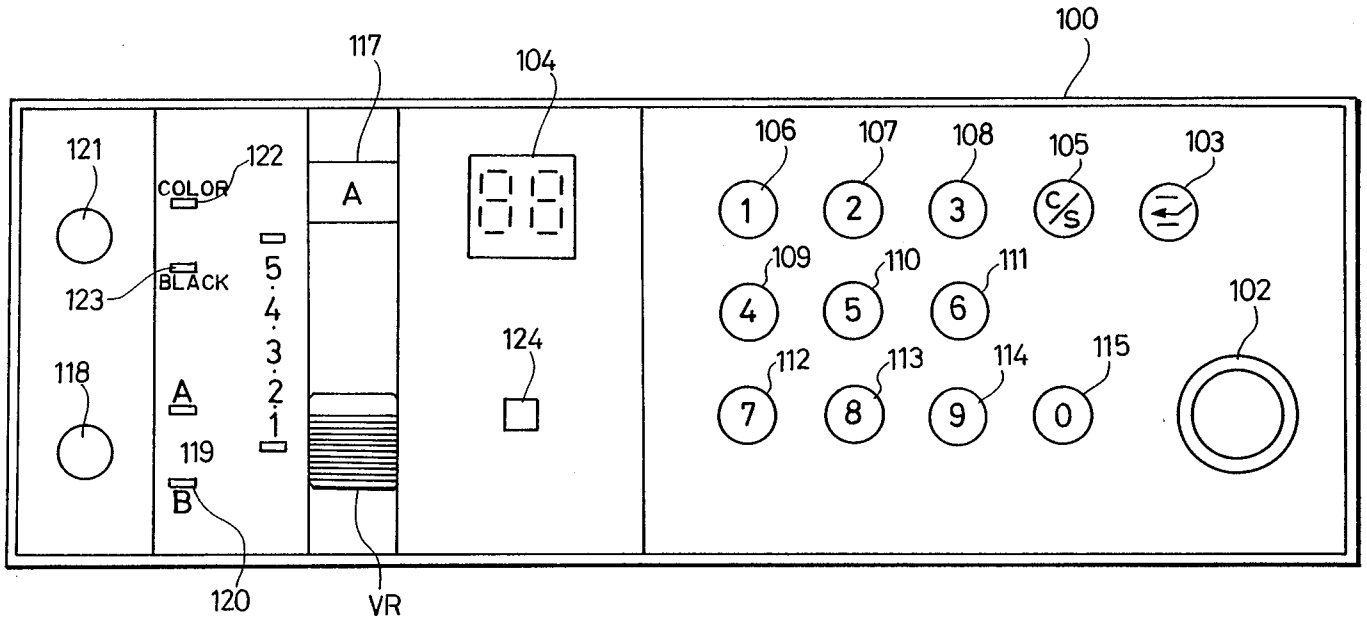
FIG. 6 is a front view of an operating panel.

In the upper portion of the copying machine 1 is mounted such an operating panel 100 as shown in FIG. 6. On the operating panel 100 are disposed a print key 102 for commanding the start of copy; an interruption key 103; a clear/stop key 105 for stopping copy just after the start of copy or during multi-copy (continuous copying of plural sheets based on the same original) and for clearing the number of sheets to be copied which was set in a number of copy sheet indicating portion 104 comprising a group of light emitting diodes (LES's), and returning it to a normal mode "1"; ten-keys 106 to 115 for setting the number of sheets to be copied in the number of copy sheet indicating portion 104; an exposure amount adjusting resistor VR for manually increasing or decreasing the exposure amount provided from the light source 12; and automatic exposure mode switch 117 for providing the most suitable exposure amount to the original or document automatically; a paper feed selection switch 118 for selecting either the first paper feed portion 28 or the second paper feed portion 30; LED's 119 and 120 for indicating the selected paper feed portion; a color/black copy selection switch (hereinafter referred to as the "color selection switch") 121 for selecting color copy or black copy; LED's 122 and 123 for indicating the developing unit 5 and 6 selected by the color selection switch; and an LED 124 for indicating that the toner supply bottle 41 or 53 attached to the selected developing unit 5 or 6 is empty.

The following description is now provided about a control circuit which makes controls for the copying machine, including control of the copying operation of the machine and a selective control for a selected developing unit of the first and second developing units.

Figure 7:
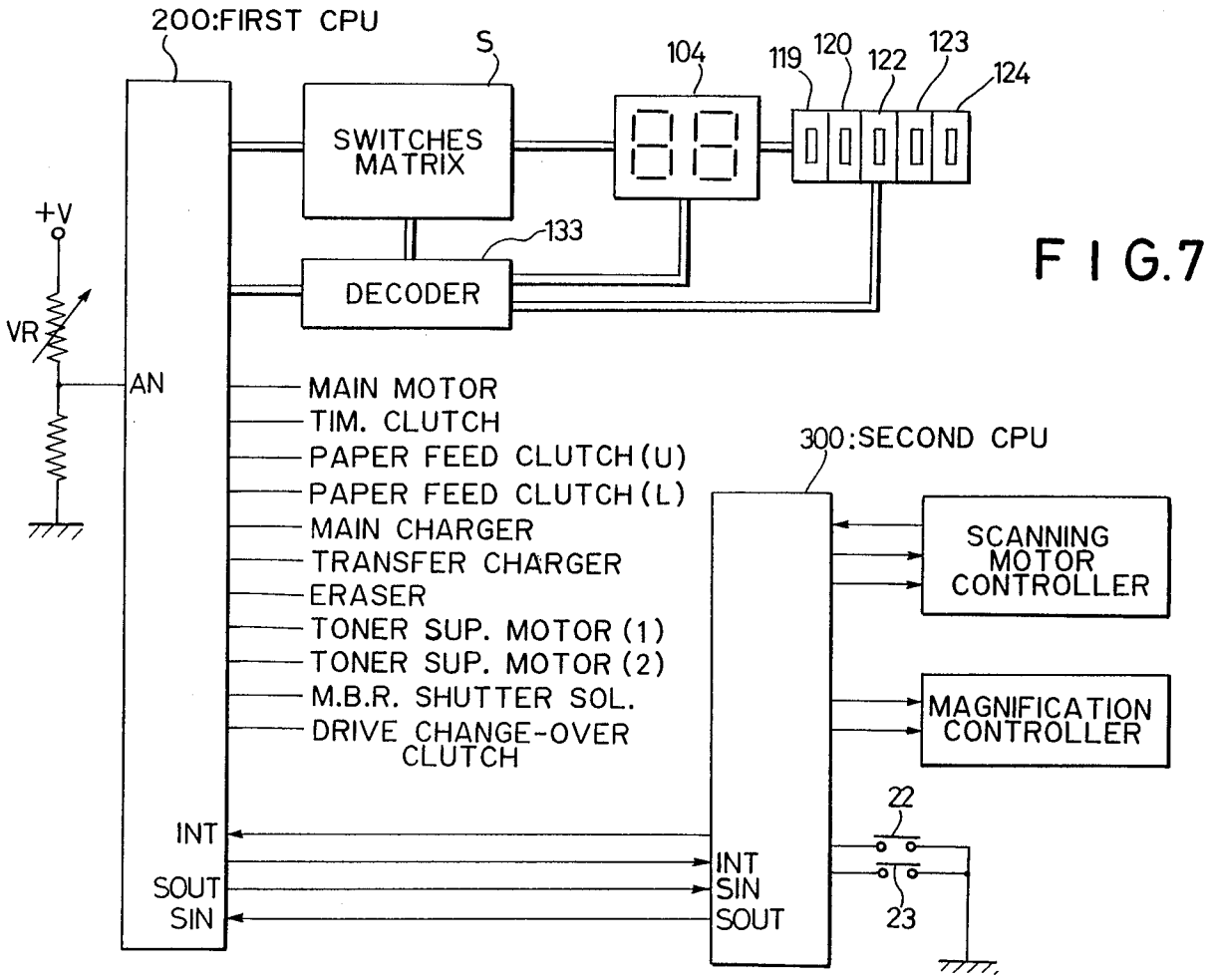
FIG. 7 is a block diagram of a control circuit.

FIG. 7 is a block diagram of the control circuit. As shown therein, the control circuit is provided with first and second microprocessors (CPU's) 200 and 300. To the first CPU 200 is connected a switch matrix S on which are arranged, lengthwise and crosswise, the various keys on the operating panel 100, first and second bottle sensors 41 and 53, first and second bottle empty sensors 46 and 60, and first and second toner color detecting reed switches 49 and 50. On the basis of the operation of the keys and that of the sensors the foregoing main motor and various roller clutches are operated and controlled by the first CPU 200 and at the same time various LED's, including the number of copy sheets indicating portion 104, are turned ON and OFF through a decorder 133.

On the other hand, to the second CPU 300 are connected a scanning motor controller, a magnification controller, as well as the document table constant position switch 22 and timing switch 23. The second CPU 300 mainly controls the optical system 0 and document scanning. The first CPU 200 and the second CPU 300 are interconnected for synchronization with each other.

Main operations of the control circuit will be outlined below.

(1) Copying Operation

In this embodiment color and black developing units are loaded in the copying machine, so it is possible to make selection between color and black copies. When the color selection switch 121 on the operating panel is operated to select color or black copy, a selection signal is fed to the first CPU 200.

The first CPU produces a signal which indicates the developing unit selected in accordance with the input signal, to turn ON either the LED 122 or 123. At this time the developing unit change-over operation is not yet started.

Such data as the size of the copying paper and the number of sheet to be copied are also fed to the first CPU from the corresponding keys on the operating panel.

Then, the print key 102 is operated to provide a copy start command signal to the first CPU, whereupon the CPU checks the developing unit selection signal which it has received. And when the developing unit selected this time is the same as the developing unit which was used in the previous copying operation and set already, the copying operation is started. The control of the copying operation will not be explained here because it is the same as that adopted in known copying machines. When the developing unit selected this time is different from that which has already been set, the first CPU performs the operation for change-over to the former developing unit, that is, the operation of rendering the selected developing unit operative and the other inoperative.

Then, a check is made of a signal which is produced upon completion of the developing unit change-over operation. And once the signal is output, the copying operation is started.

(2) Developing Unit Loading Detection Processing

In this embodiment the first developing unit 5 charged with color toner is detachable, while the second developing unit 6 charged with black toner is fixed. In the case where the first developing unit is not loaded or it is removed during copying operation, even if a latent image is formed on the photosensitive drum, it is erased by extraneous light, making it impossible to effect copying. More specifically, detection is made as to whether the developing unit is loaded or not before and during the copying operation, and upon detection of it being not loaded, the copying operation is stopped by the same operation as that which is performed when the clear/stop key is depressed.

When the first CPU 200 has detected that the reed switches 49 and 50 for detecting the toner color discriminating magnets 47 and 48 which are attached to the first developing unit 5, are both OFF, it is judged that the first developing unit has been removed and control of copying machine is performed on the basis of this judgment.

(3) Quick Toner Supply Processing

The developer used in the copying machine of this embodiment is a mixture of toner and magnetic carrier. When the copying operation is being performed continuously, particularly for a document having a high image density, the percentage of toner decreases and the image density lowers. So it is necessary for the operator to supply toner and mix it with the magnetic carrier thoroughly during the copying operation. Further, if toner is supplied by mistake when the toner content percentage of the developer is sufficiently high, there will occur troubles, for example the toner will overflow from the developing unit, so it is necessary to take care not to make unnecessary supply of toner.

In the quick toner supply, therefore, when "0" of the ten-key and a drum dry switch (not shown) attached to for example a side part of the copying machine are turned ON, the first CPU 200 receives these signals and drives the toner supply motor for either the developing unit 5 or 6 which is under selection, to supply toner to the developing unit 5 (or 6) from the toner bottle 45 (or 58). Further, when the drum dry switch is judged to be ON, the agitation bucket 72 adapted to rotate together with the developing sleeve 76 of the selected developing unit 5 or 6 is driven by the main motor to agitate the developer.

Then, the toner content percentage of the developer in the developing unit 5 or 6 is detected on the basis of the quantity of magnetism of the magnetic carrier, and when the detected toner content percentage is above a predetermined value, the supply of toner is inhibited. When the copy mode is changed from black to color copy during quick toner supply, the quick toner supply is discontinued and the agitating operation is restarted after the end of the copying operation. This is because if the agitating operation is performed in both developing units simultaneously, it is likely that the load on the main motor will become excessive, providing an obstacle to the copying operation.

As explained above, the developer is agitated upon turning ON of the drum dry switch. In this connection, the drum dry processing will now be explained briefly. Where the copying machine is placed in a cold room for a long time, its photosensitive drum is sometimes dewed. This occurs when the copying machine is used in a cold district for example. To prevent such dew condensation, the photosensitive drum is rotated for a predetermined time before using the copying machine and the main eraser is lit to warm up the photosensitive drum and at the same time an air flow is created to dry the photosensitive drum. This processing is referred to herein as a drum dry processing. Since the photosensitive drum is rotated in the drum dry processing, the developing sleeve and the agitating bucket also rotate to agitate the developer. So also for the agitation of the developer in the quick toner supply there is performed the drum dry processing.

(4) Function Inspection Processing

This processing is an inspection processing for the copying machine, involving test modes F2, F3 and F4 and handling the main charger, exposure lamp and counting the adjustment timing of the ATDC sensor which detects the toner content percentage of the developer. Input of those test modes is made using keys by a serviceman. The processing of counting the adjustment timing of the ATDC sensor will be explained below.

As previously noted, the ATDC sensor is for detecting the quantity of magnetism of the magnetic carrier contained in the developer to thereby determine the content percentage of toner. Sufficient agitation is made after loading the starting developer (starter) into a developing unit, and then the calibration of the ATDC sensor is made. The processing of counting the adjustment timing of the ATDC sensor is a counting processing using an agitation time counting timer. Indication during and after the end of counting is made by the following developing unit indication processing.

(5) Selected Developing Unit Indicating Processing

This processing comprises a processing of indicating which of color and black copies is selected, that is, which of the color and the black developing unit is selected; a processing of flickering the indicating element of the developing unit concerned during the agitation of the developer which is necessary for the adjustment of the ATDC sensor, and lighting the said indicating element continuously after the end of the agitation; and a processing in which when the toner supply bottle of the developing unit not in use for development has become empty, the indicating element of the said developing unit is flickered for the replenishment of toner, which processing is for indication and preparation in advance because the replenishment of toner, including replacement of the toner supply bottle, is time-consuming.

(6) Magnetic Brush Removing Processing

As referred to in the previous explanation on the construction of the developing units, this processing comprises the following. The first is a processing in which at the time of change-over from the black developing unit which has so far been selected to the color developing unit, the magnetic brushes of the black developer formed on the developing sleeve of the black developing unit are recovered. The second is processing in which after the end of color copying and turning OFF of the main motor, a predetermined time is allowed to elapse so that the operation of the main motor stops completely, and thereafter the drive change-over clutch which makes change-over of the drive connection mechanism located between developing unit and the main motor is turned OFF for change-over to the black developing unit. By so doing, at the time when the main motor is brought into connection with the black developing unit, the developing unit does not rotate so there will be formed no magnetic brush of the black developer on the developing sleeve. Therefore, in a completely stopped and stand-by state after the end of color copying, the magnetic brush removing processing is not needed even if the color copying mode is set. The third is a drive change-over processing for the developing unit concerned which is executed before turning ON the main motor when the color copying mode is set again after the end of color copying. By so doing, upon turning ON of the main motor, the color developing unit starts rotating, while the black developing unit does not begin to rotate, so there will be formed no magnetic brush of the black developer on the developing sleeve. If the drive change-over from one to the other developing unit is done simultaneously with turning ON of the main motor, there is the possibility that the black developing unit will rotate for an instant to form a magnetic brush on the developing sleeve.

The following description is now provided about control operations for the above processings performed by the CPU's 200 and 300 on the basis of the flowcharts of FIGS. 8 to 37, in which flowcharts the color developing unit 5 alone is assumed to be removable.

(1) Main Routine

Figure 8:
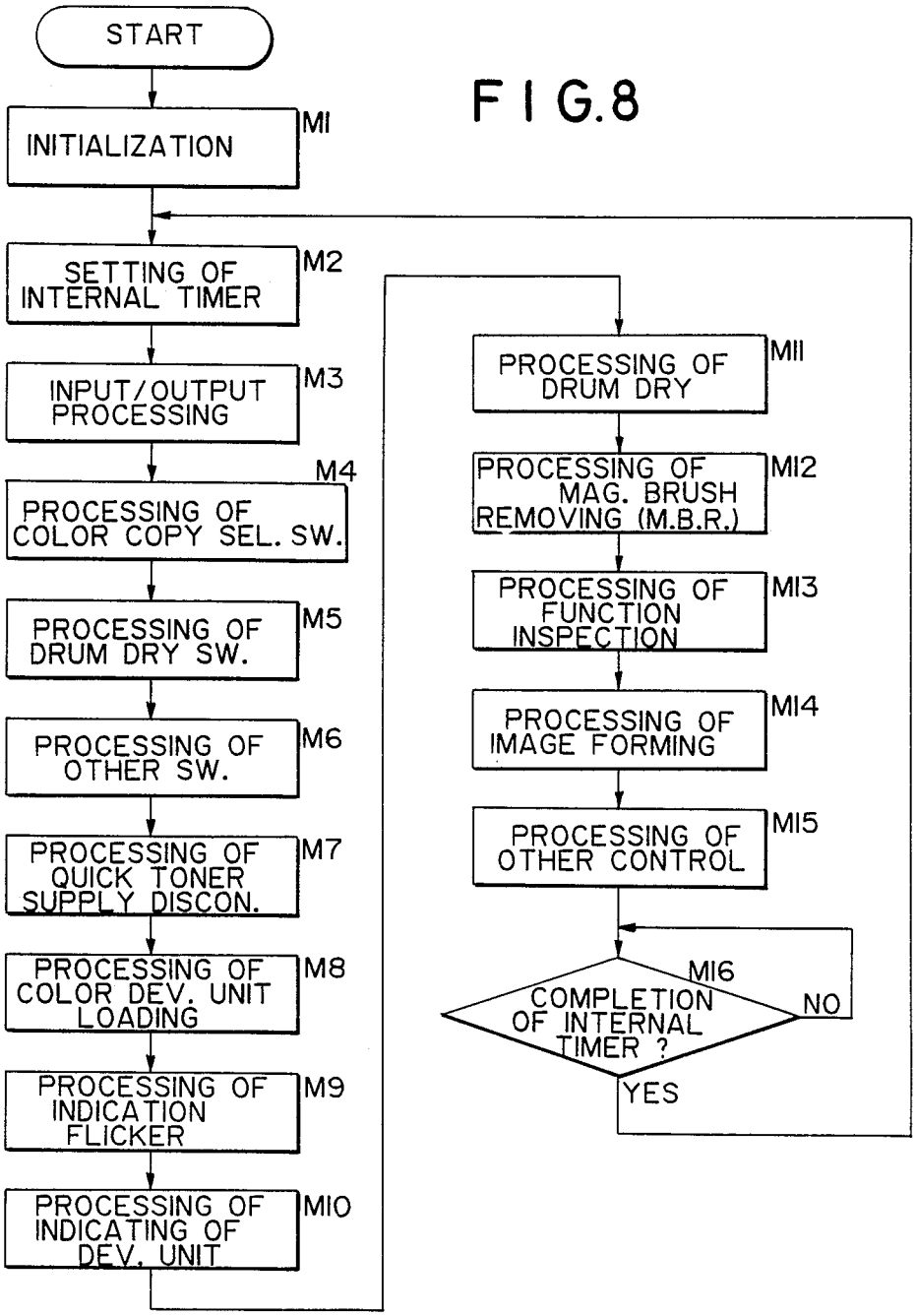

The flowchart of FIG. 8 shows an outline of control operations of the image forming apparatus. Application of power to start operation is followed by initialization of memory and that of flag, etc., setting the number of sheet to be copied to "1" and initializing of copying mode (step M1).

Then, an internal timer for controlling the processing time of the main routine is set and started counting (step M2) and there are performed processing of input and control output signals for the image forming apparatus (step M3), followed by processings of a color copy selection switch and a drum dry switch (steps M4 and M5) as will be later explained in detail. Further, a signal processing is performed for signals which have been input from switches on the operating panel, etc. (step M6), followed by a series of processings (steps M7 to M13) which are quick toner supply discontinuing processing, color developing unit loading detection processing, indication flicker processing, selected developing unit indicating processing, drum dry processing, magnetic brush removing processing, and function inspection processing. Then, a known image forming processing is performed, including electric charging to the photosensitive drum, exposure, development, feed and transfer of copying paper, fixing, etc. (step M14). Further, other control processings such as the detection of jam of transfer paper and that of other troubles (step M15), followed by waiting for the end of counting of the internal timer (step M16), and the routine returns to step M2 for the next cycle of processings.

Routines which have direct bearing on the present invention will be described below in detail.

(2) Color Copy Selection Switch Processing Routine

Figure 9:
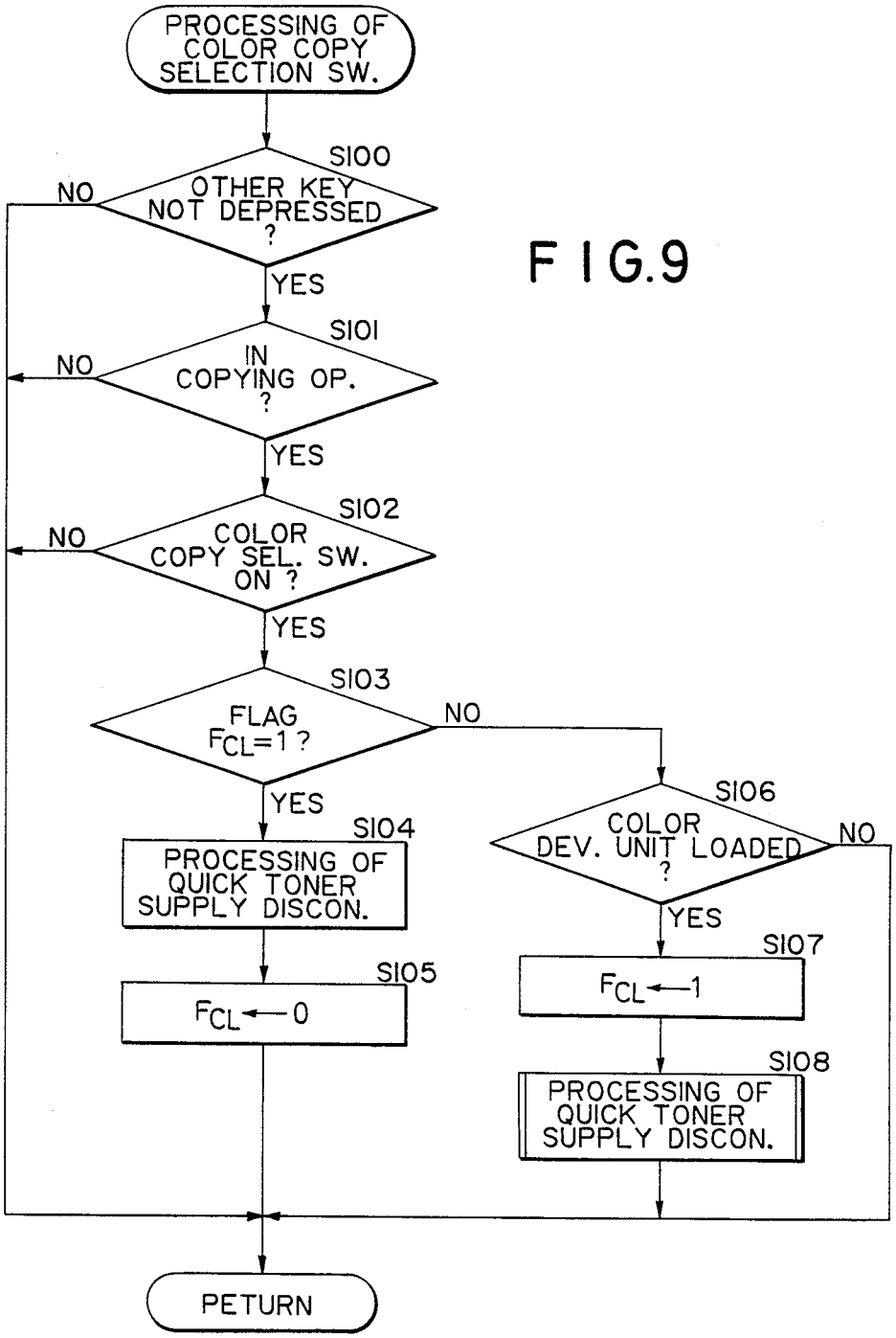

The color copy selection switch processing of step M4 in the flowchart of FIG. 8 will be fully explained below with reference to the flowchart of FIG. 9.

When color copy is desired, the color copy selection switch 121 on the operating panel is turned ON. If the quick toner supplying operation is being performed at this time, it is discontinued. First, it is confirmed that the other key switches are not depressed and that a copying operation is not under way (steps S100 and S101). Then, the state of the color copy selection switch is checked (step S102) and if the switch is ON, there is made a check as to whether a flag $F_{CL}$ indicative of the selection of the color copying mode is "1" or not (step 103). If the answer is affirmative, it means that the color developing unit has already been selected, so the quick toner supply discontinuing processing is performed (step S104) and the flag $F_{CL}$ is reset to "0" into the black copying mode. And the processing is terminated. On the other hand, if the flag $F_{CL}$ is not "1" in step S103, the routine transfers to step S106 to check whether the color developing unit 5 has been loaded or not, and if the answer is negative, the processing is terminated, while if the answer is affirmative, the flag $F_{CL}$ is set to "1" into the color copying mode and the quick toner supply discontinuing processing is performed (steps S107 and S108). Then, the processing is terminated. The quick toner supply discontinuing processing will be later explained in detail.

(3) Drum Dry Switch Processing Routine

Figure 10:
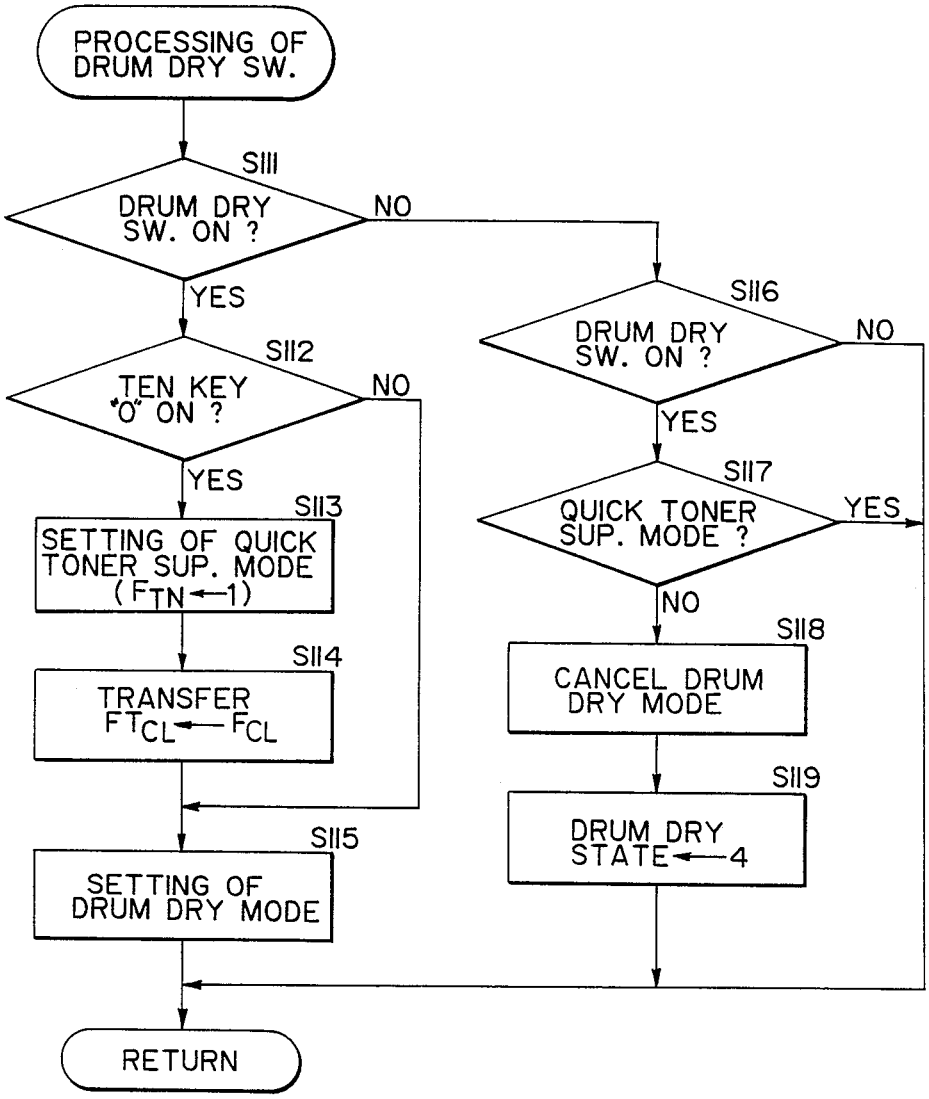

The drum dry switch processing of step M5 in the flowchart of FIG. 8 will now be explained in detail with reference to the flowchart of FIG. 10. This switch is for removing dew condensed on the photosensitive drum and also for setting the start of quick toner supply. First, the drum dry switch is depressed and a check is made as to whether an ON trigger was output or not (step S111). If the answer is affirmative, a check is made as to whether the "0" of the ten-key is ON or not (step S112) and if the answer is affirmative, it follows that the quick toner supply is commanded, so a flag $F_{TN}$ is set into the toner supply mode (S113) and the contents of the flag $F_{CL}$ are transferred as the contents of a flag $FT_{CL}$ to store the set toner mode (black or color) (step S114). Then, the drum dry mode is set (step S115) and the processing is terminated. If the ten-key is not ON in step S112, it means that the quick toner supply is not commanded, so routine transfers to step S115. When there is no output of the ON trigger of the drum dry switch in step S111, routine transfers to step S116, in which a check is made as to whether there is an output of OFF trigger which is provided when the drum dry switch is turned OFF. If the answer is affirmative, a check is made as to whether the present mode is the toner supply mode or not (step S117). This is for the following reason. If the drum dry switch is turned OFF during the supply of toner in the toner supply mode, the supplied toner will not be thoroughly agitated with the carrier, thus providing an obstacle to the development, so in this case the agitation of the developer is to be continued. Therefore, when the present mode is judged to be the toner supply mode in step S117, the processing is terminated immediately, while when it is not the toner supply mode, the drum dry mode is cancelled and a drum dry state is set to "4", then the processing is terminated. As to the dry drum state, it will be explained later in connection with the drum dry processing.

(4) Quick Toner Supply Discontinuing Processing Routine

Figure 11:
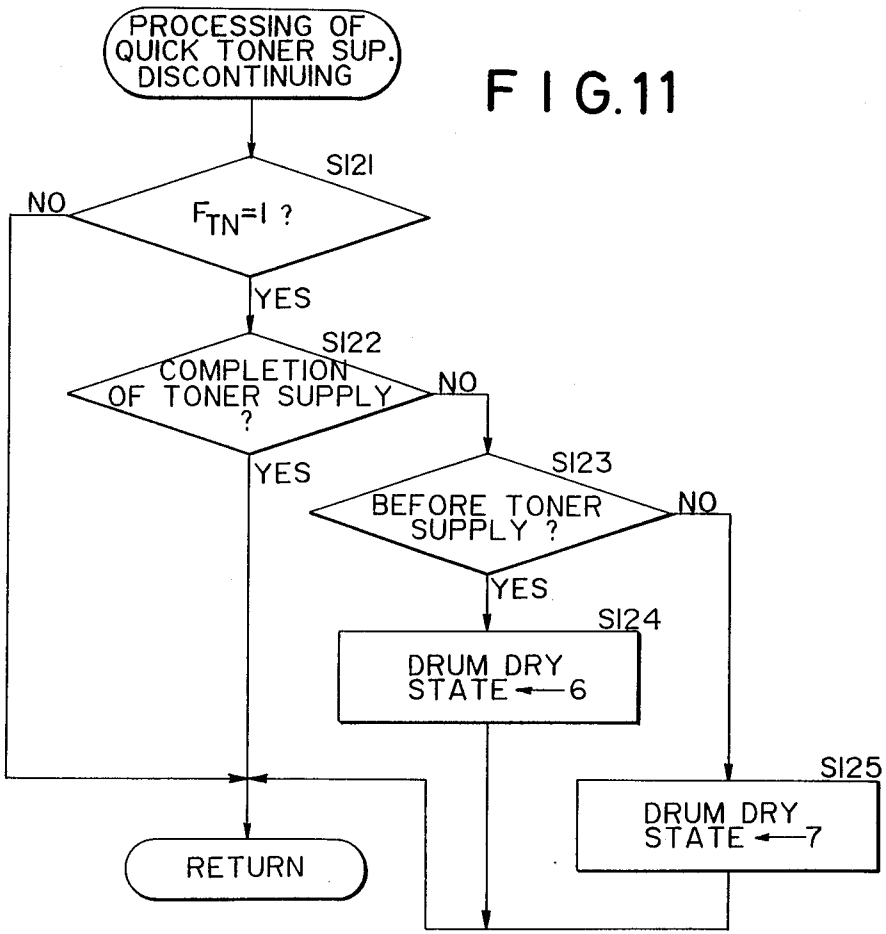

The quick toner supply discontinuing processing of step M7 in the flowchart of FIG. 8 will now be explained in detail with reference to the flowchart of FIG. 11. The discontinuance of the quick toner supply is done upon turning ON of the color copy selection switch, corresponding to the processing of steps S104 and S108 in the flowchart of FIG. 9.

First, a check is made as to whether quick supply of toner is being performed or not, using the flag $F_{TN}$ which indicates the toner supply mode (step S121) and if $F_{TN}=1$, that is, if the present mode is the toner supply mode, a check is made as to whether the toner supply is over or not (step S122). If the answer is negative, a check is made as to whether the supply of toner has not been started yet, and if the answer is affirmative, "6" is set to the drum dry state in the later-described drum dry processing routine, while if the answer is negative, "7" is set to the drum dry state (steps S123, S124 and S125) and the processing is terminated. When the flag $F_{TN}\neq 1$ in the judgement of step S121 and if the supply of toner is judged to be over in step S122, the processing is terminated.

(5) Color Developing Unit Loading Detection Routine

Figure 12:
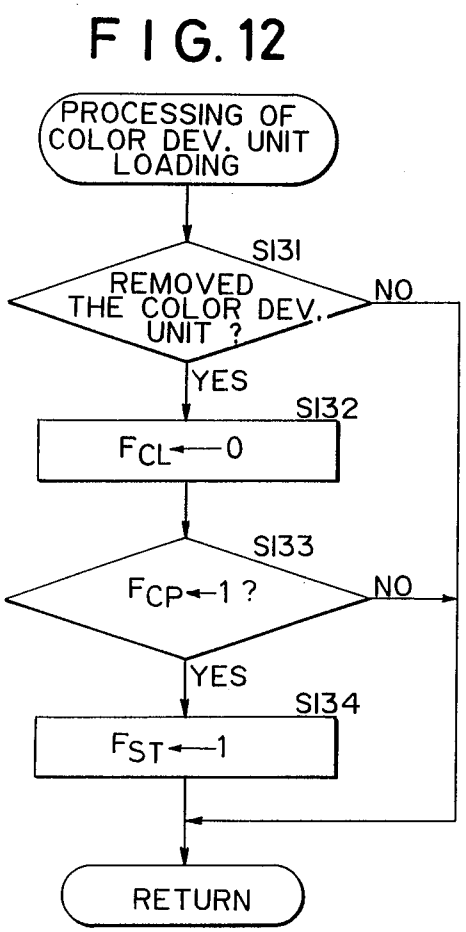

The color developing unit loading detection processing of step M8 in the flowchart of FIG. 8 will be explained in detail below with reference to the flowchart of FIG. 12.

First, whether the color developing unit has been removed from the body of copying machine or not is detected (step S131). More specifically, when a code signal from the toner color detecting magnets attached to the color developing unit has turned OFF, it is detected that the developing unit has been removed. In this case, the flag $F_{CL}$ is reset to "0" for changeover into the black toner developing mode. If the copying operation is being performed, then in order to stop the copying operation, a check is made as to whether the flag $F_{CL}$ which indicates the copying operation is "1" or not, and if the answer is affirmative, a flag $F_{ST}$ for stopping the copying operation is set to "1" (steps S133 and S134) and the processing is terminated. If the results of the judgment in steps S131 and S133 are negative, the processing is terminated immediately. The control for stopping the copying operation on the basis of the judgment about the state of the flag $F_{ST}$ is the same as the stopping control which is made upon depression of the clear/stop key on the operating panel.

(6) Drum Dry Processing Routine

The drum dry processing of step M11 in the flowchart of FIG. 8 will be explained below in detail with reference to the flowchart of FIG. 13 to FIG. 19.

Figure 13:
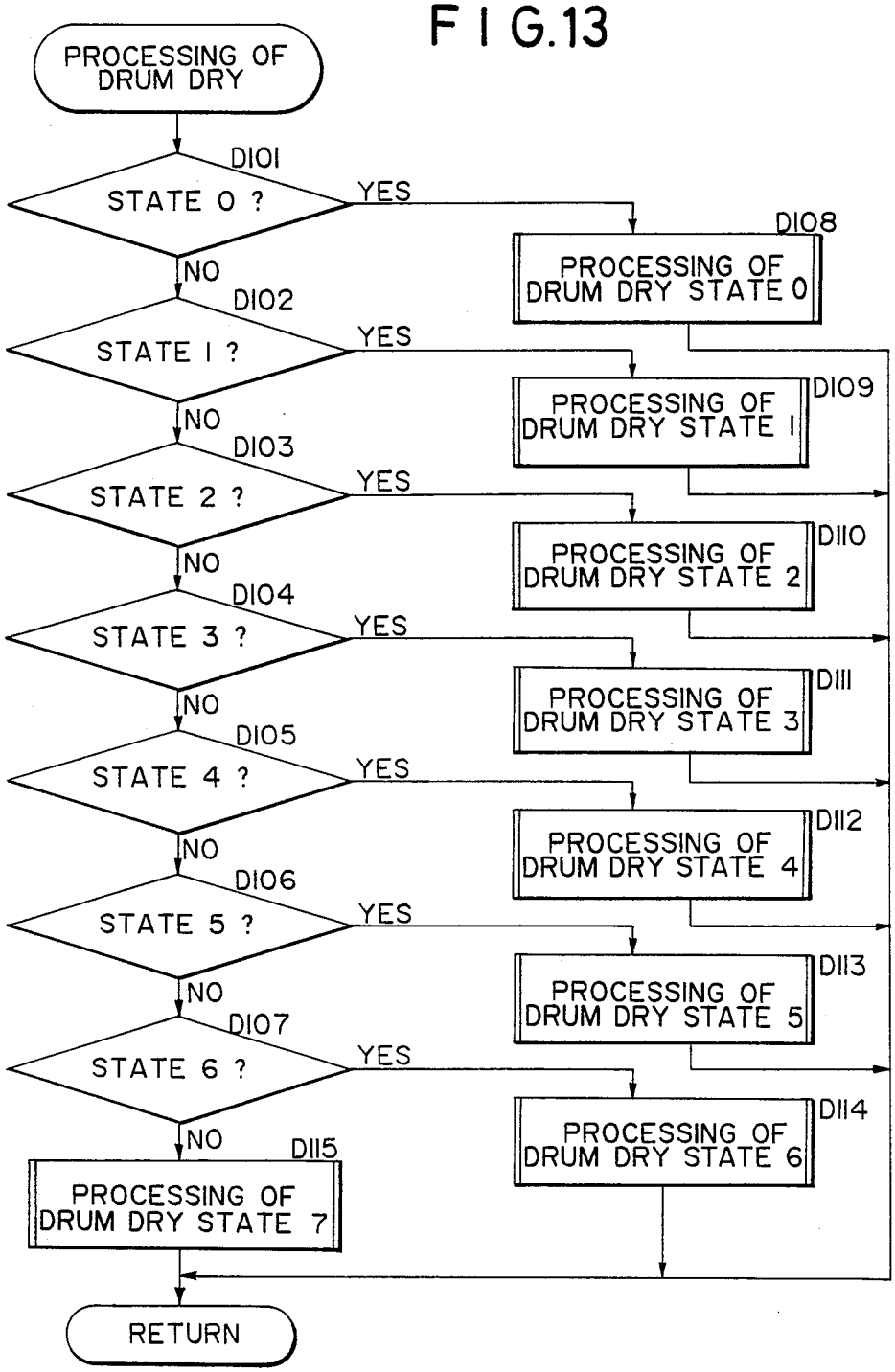

FIG. 13 shows subroutine processings from state "0" to state "7" which are adopted in the drum dry processing. The state numbers set to the subroutines are judged (steps D101 to D107) and the routine transfers to the corresponding subroutines (steps D108 to D115) to effect processings.

Figure 14:
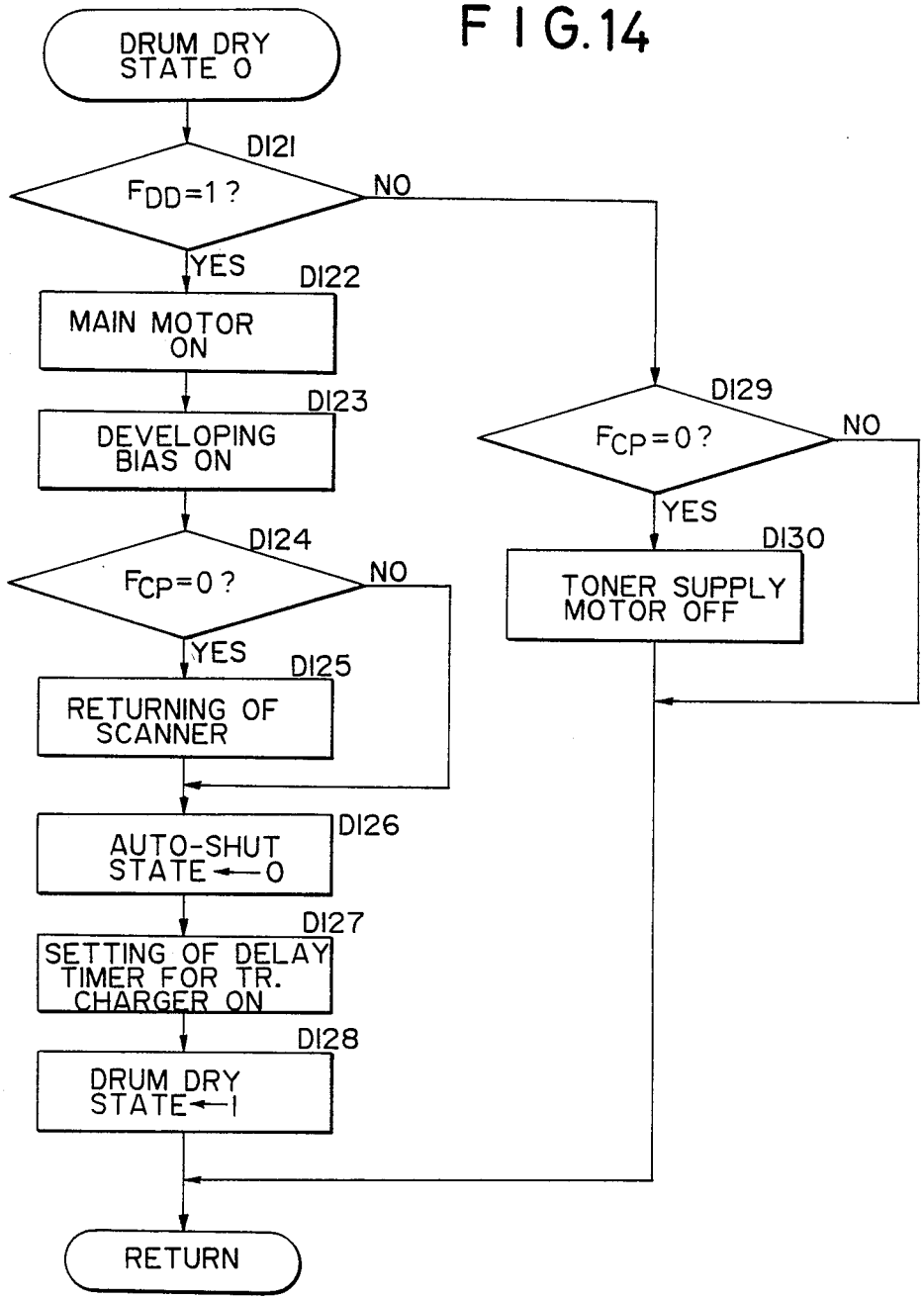

FIG. 14 is a flowchart of drum dry state "0", in which the drum dry processing is started. First, a check is made as to whether a drum dry mode flag $F_{DD}$ is "1" or not (step D121), and if the answer is affirmative, that is, if the drum dry mode is under way, the main motor is turned ON and the developing bias also ON (steps D122 and D123). Then, a check is made as to whether the copying operation is being performed or not and if the copying operation is not being performed, the scanner is returned to the scan start position (steps D124 and D125), while when the copying operation is being performed, the processing of step D125 is omitted. Autoshut state is set to "0" to prevent the start of an automatic stopping operation, then a delay timer for delaying the timing of turning the transfer charger ON is set, and the drum dry state is set to "1" (steps D126 to D128). Now the processing is terminated. The reason why the transfer charger is turned ON later than turning 0N of the main motor is that it is intended to prevent the transfer charger from operating into the state of overcharge before the main motor reaches the normal operation speed.

As a result of the judgment in step D121, if the present mode is not the drum dry mode, a check is made as to whether a copy flag $F_{CP}$ is "0" or not and if the copying operation is not being performed, the toner supply motor is turned OFF (steps D129 and D130) and the processing is terminated, while when the copying operation is being performed, the processing of step D130 is omitted.

Figure 15:
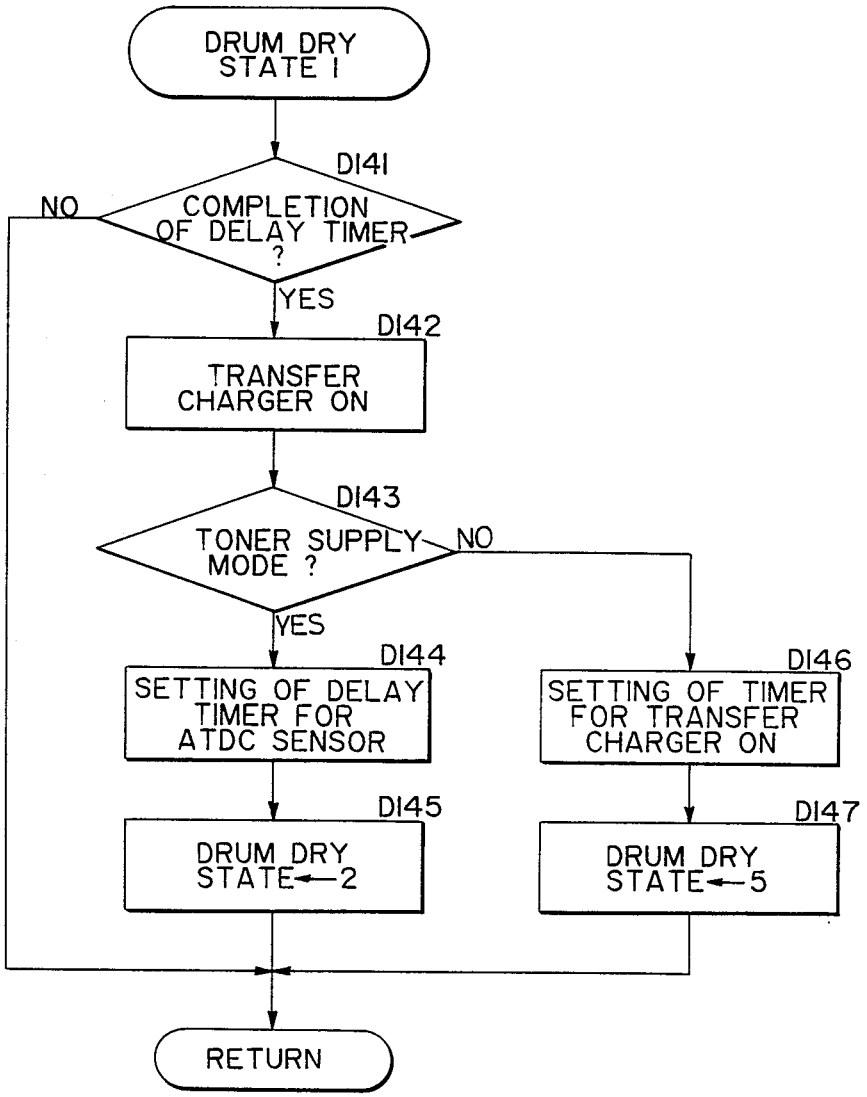

FIG. 15 is a flowchart of drum dry state "1", in which there are performed turning ON of the transfer charger and preparations for detecting the toner content percentage. First, a check is made as to whether the transfer charger ON delay timer which has been set at state "0" is timed out or not (step D141) and if the answer is negative, the processing is terminated, while if the answer is affirmative, the transfer charger is turned ON (step D142) and a check is made as to whether the present mode is the toner supply mode or not, using the flag $F_{TN}$ (step D143). If the answer is affirmative, a delay timer for delaying the start of detection of the ATDC sensor is set and the drum state is set to "2" (steps D144 and D145), then the processing is terminated. On the other hand, if the answer is negative, a timer for defining the transfer charger ON time in the drum dry processing is set and the drum dry state is set to "5" (steps D146 and D147), then the processing is terminated.

Figures 16, 18:
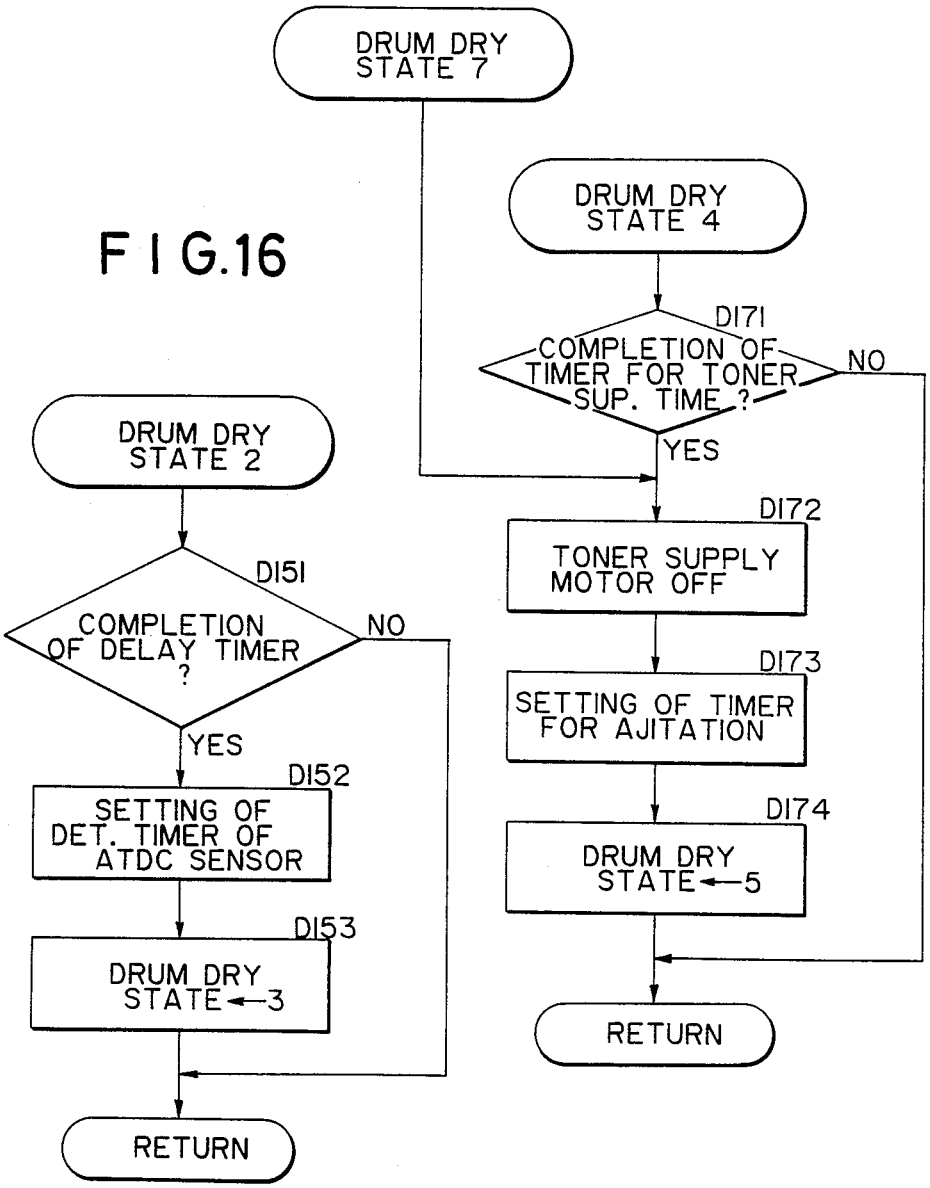

FIG. 16 is a flowchart of drum dry state "2". In this processing, a check is made as to whether the ATDC sensor detection start delay timer which was set in state "1" is timed out or not (step D151) and if the answer is negative, the processing is terminated. On the other hand, if the answer is affirmative, a timer for defining the detection time of the ATDC sensor is set, detected signals provided from the ATDC sensor during the operation of the said timer are read, then a mean value thereof is determined and the drum dry state is set to "3" (steps D152 and D153), and the processing is terminated.

Figure 17:
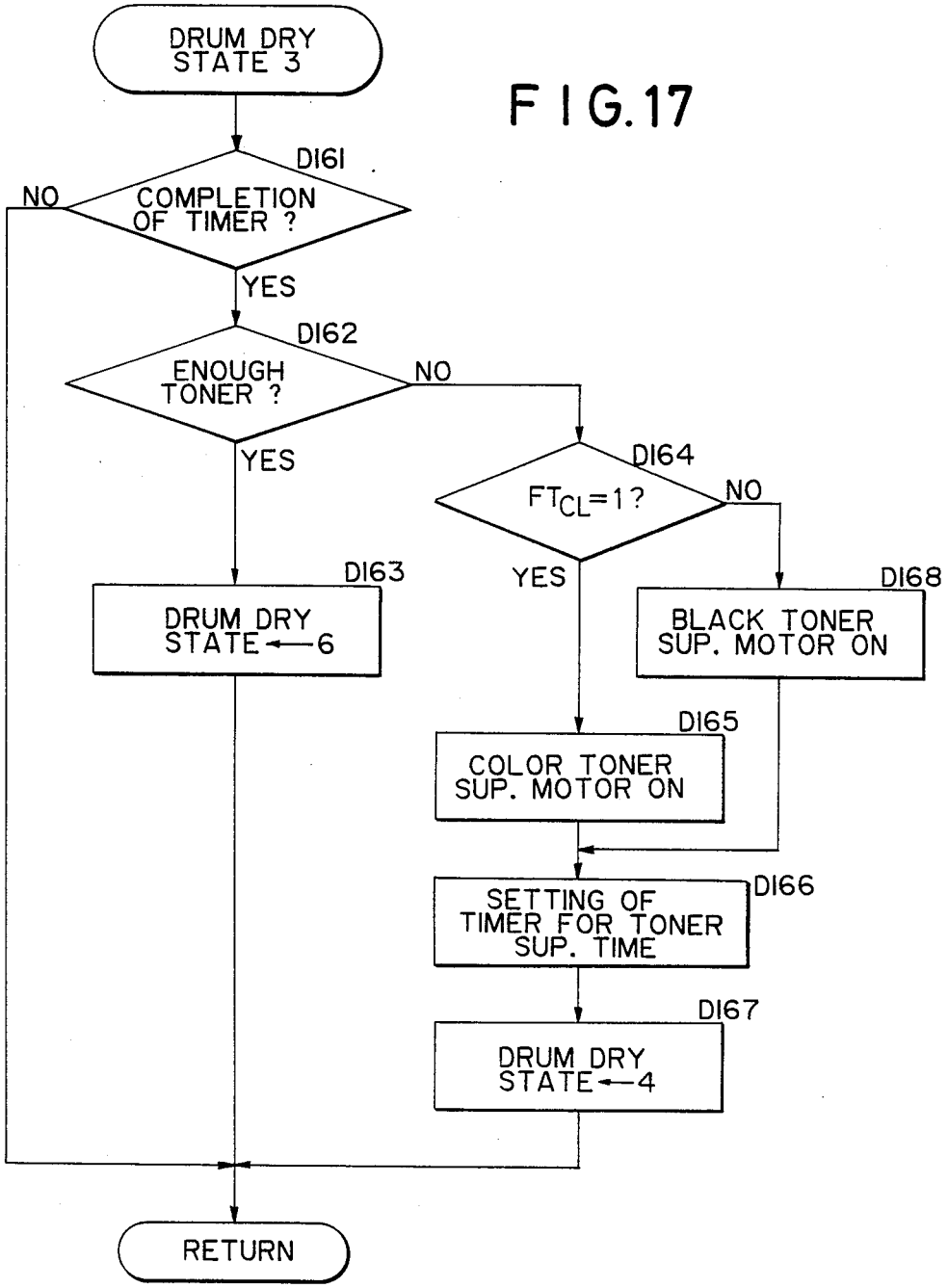

FIG. 17 is a flowchart of drum dry state "3" in which there is performed the toner supply processing. First, a check is made as to whether the timer for defining the detection time of the ATDC sensor which was set in state "2" is timed out or not (step D161) and if the answer is negative, the processing is terminated. On the other hand, if the answer is affirmative, a check is made as to whether the toner content percentage detected by the ATDC sensor is lower than a predetermined value or not (step D162) and if the answer is affirmative, the drum dry state is set to "6" (step D163) and the processing is terminated. On the other hand, if the toner content percentage is below the predetermined value, a check is made as to whether the toner to be supplied is color or black, using the flag $FT_{CL}$, then the toner supply motor to the color developing unit 5 or the black developing unit 6 is turned ON in accordance with the result of the judgment, and a toner supply time timer is set and the drum dry state is set to "4" (steps D164 to D167), and the processing is terminated.

FIG. 18 is a flowchart of drum dry states 4 and 7. According to the routine shown therein, the supply of toner is terminated and the agitation of the developer is performed. First, program control transfers to this routine in the drum dry state "4", a check is made as to whether the counting of the toner supply time defining timer which was set in the drum dry state "3" is over or not (step D171) and if the answer is negative, the processing is terminated. On the other hand, if the answer is affirmative, the toner supply motor is turned OFF, a timer for agitating the developer in the toner-supplied developing unit for a predetermined time is set, the developing unit is operated and the drum dry state is set to "5" (steps D172 to D174), and the processing is terminated.

In the drum dry state "7", routine starts from step D172.

Figure 19:
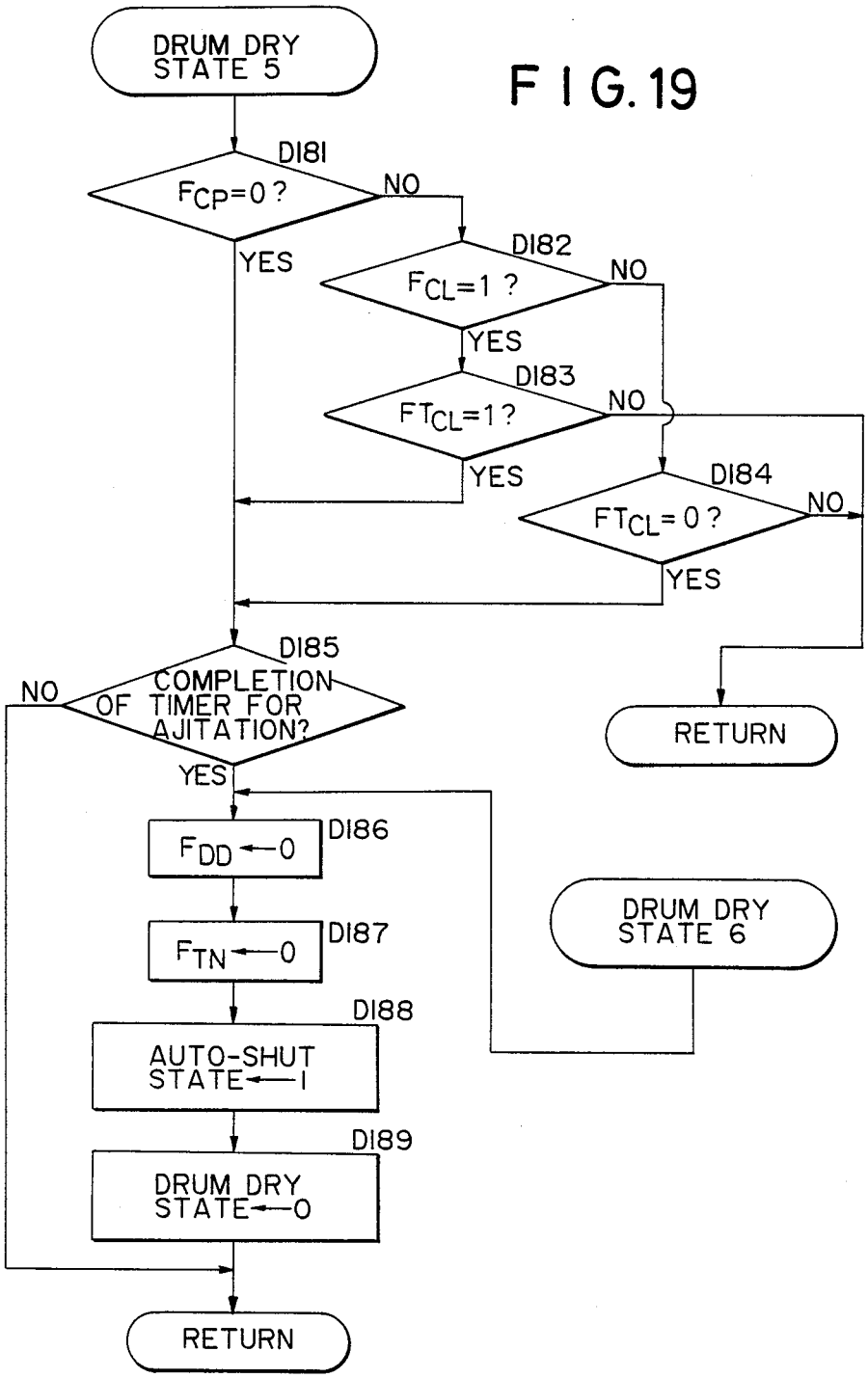

FIG. 19 is a flowchart of drum dry states 5 and 6. When program control transfers to this routine in the drum dry state 5 and when toner is supplied to the developing unit which is not used for copying during copying operation, the agitation of the developer in that developing unit cannot be performed, so it is re-started after the end of copying.

When program control transfers to this routine in the drum dry state "6", the drum dry processing is terminated.

Upon shift to this routine in the drum dry state "5", a check is made as to whether copying operation is under way or not, using the flag $F_{CP}$ (step D181) and if $F_{CP}=0$, that is, if copying operation is being performed, the counting of the agitation time is continued when color toner is supplied in the color copying mode, while when black toner is supplied in the color copying mode or when color toner is supplied in the black copying mode, there is made a judgment to terminate the processing without performing agitation (steps D182 to D184).

If it is judged that the copying operation is not under way in step D181 and that the agitation can be continued in steps D182 to D184, the routine transfers to step D185, in which the agitation timer is operated and the end of counting is judged. If the counting is not over, the processing is terminated, while when the counting is over, the drum dry flag $F_{DD}$ and the toner flag $F_{TN}$ are reset to "0", the auto-shut state is set to "1" and a termination processing is started, the drum dry state is rest to "0" (steps D186 to D189), and the processing is terminated.

(7) Function Inspection Processing Routine

The function inspection processing of step M13 in the flowchart of FIG. 8 will be explained below in detail with reference to the flowcharts of FIGS. 20 to 24.

Figure 20:
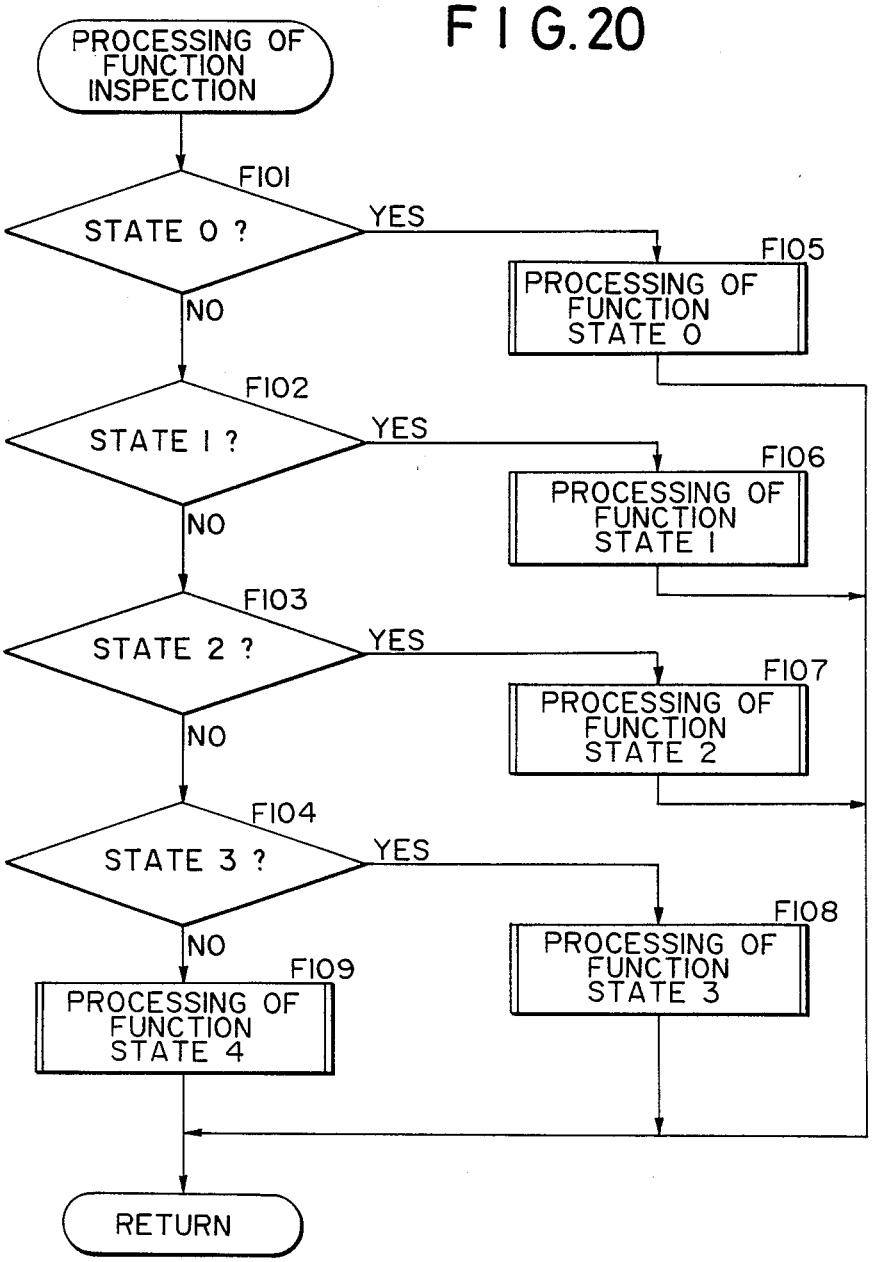

FIG. 20 shows subroutine processings from state "0" to state "4" which are adopted in the function processing. State numbers which are set to the subroutines of state "0" to state "4" are judged (steps F101 to F104) and execution shifts to the corresponding subroutine (steps F105 to F109) to perform processings.

Figures 21, 24:
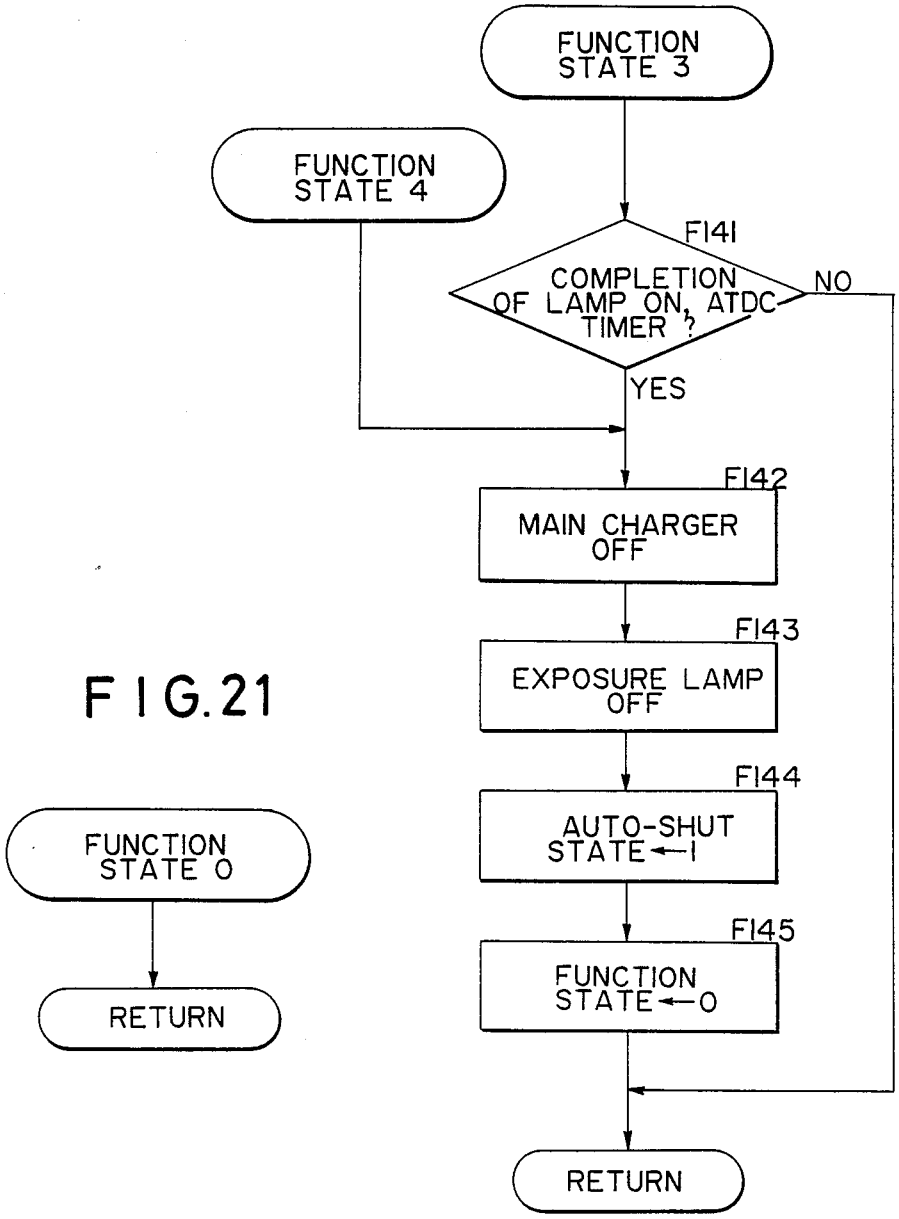

FIG. 21 is a flowchart of function state "0". Since this state is a stand-by state, the routine returns to the main routine immediately.

Figure 22:
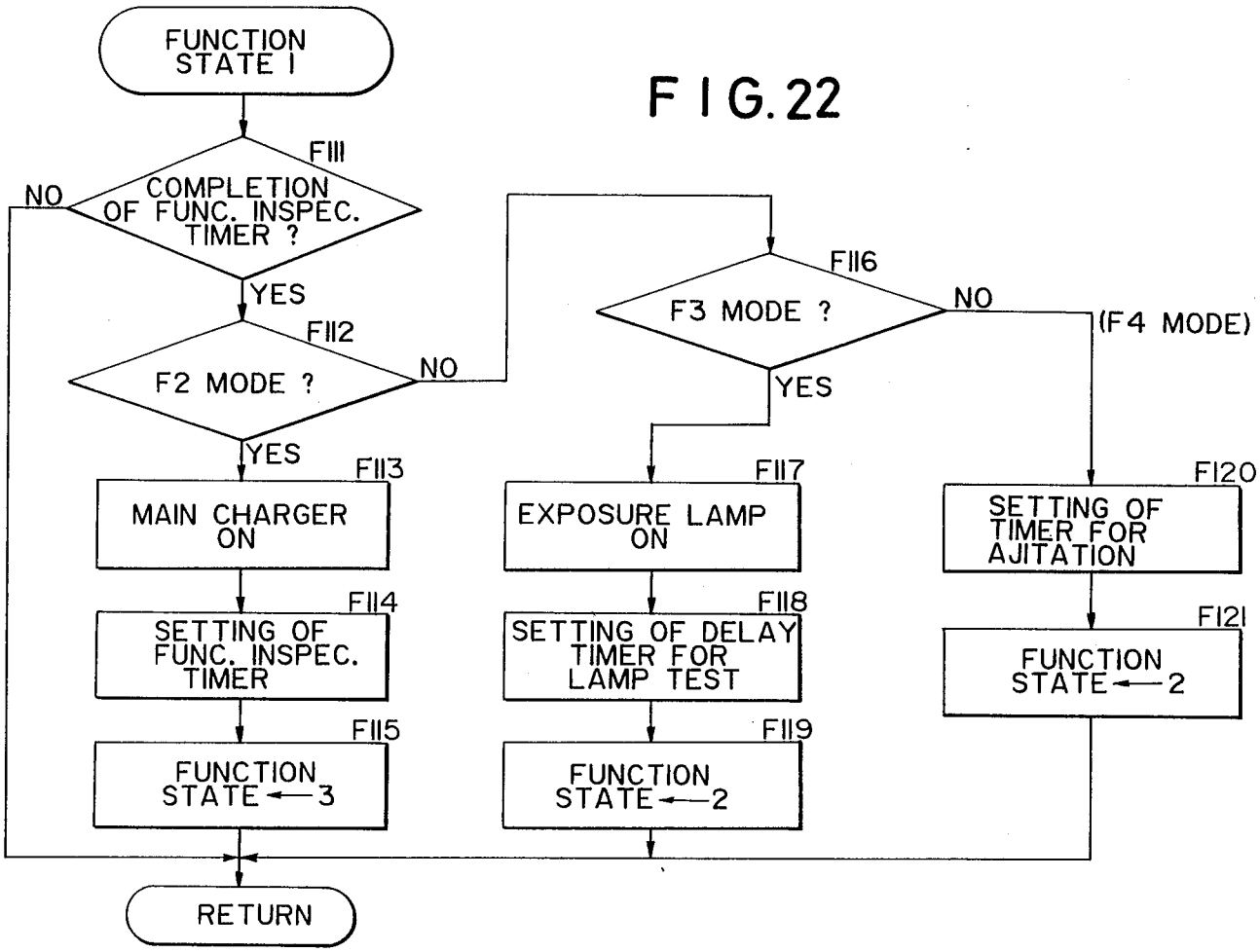

FIG. 22 is a flowchart of function state "1". When the serviceman turns ON a test mode switch of the copying machine, the main motor is driven to rotate the photosensitive drum and agitate the developing units and at the same time state "1" is set to enter this routine. First, a check is made as to whether a function inspection time counting timer is timed out or not (step F111) and if the answer is negative, the processing is terminated, while if the answer is affirmative, there is made a judgment as to whether F2 mode operation for testing the main charger is under way or not (step F112) and if the answer is affirmative, the main charger is turned ON, the function inspection timer is set and the function state is set to "3" (steps F113 to F115), and the processing is terminated.

If the test mode is judged to be not F2 mode in step F112, the routine transfer to step F116, in which there is made a judgment as to whether the test mode is F3 mode for testing the exposure lamp. If the answer is affirmative, the exposure lamp is turned ON, then a lamp test start delay timer is set to ensure the time required for the quantity of light of the lamp to become sufficient to permit a stable test, then the function state is set to "2" (steps F118 and F119) and the processing is terminated.

If the test mode is judged to be not F3 mode in step F116, it indicates the F4 mode to detect the toner content percentage in the developer, and a developer agitation time counting timer is set to mix the toner and carrier uniformly before the detection of toner content percentage. Then, the function state is set to "2" (step F120, F121) and the processing is terminated.

Figure 23:
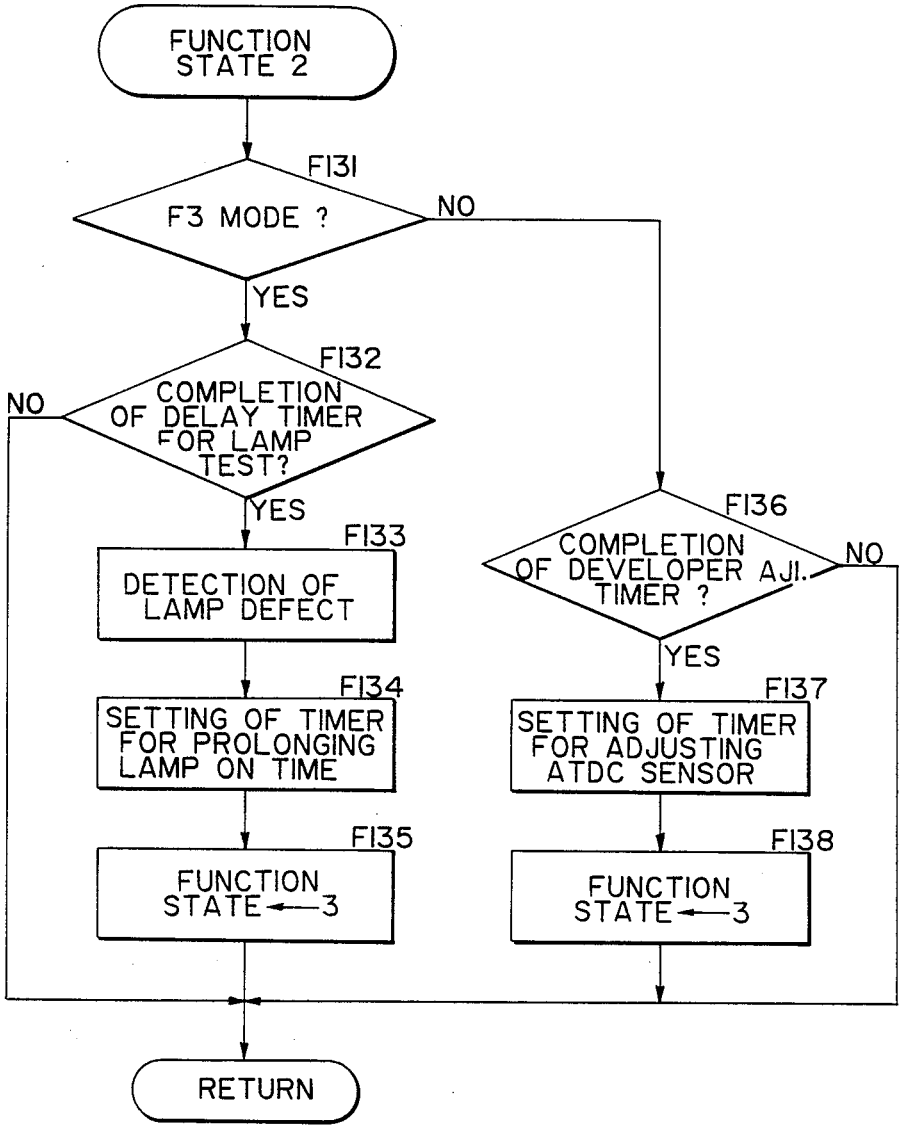

FIG. 23 is a flowchart of function state "2". First, a check is made as to whether the test mode is F3 mode or not (step F131) and if the answer is affirmative, a check is made as to whether the lamp test start delay timer which was set in step F118 of state "1" is timed out or not (step F132). If the answer is negative, the processing is terminated, while if the answer is affirmative, a defect of the exposure lamp such as, for example, deficient quantity of light or failure to light is detected and indicated, then a timer for prolonging the exposure lamp ON time is set, then the function state is set to "3" (steps F133 to F135) and the processing is terminated. When the test mode is judged to be not F3 mode in step F131, the routine transfers to step F136 to check whether the developer agitation timer which was set in step F120 of state "1" is timed out or not (step F136) and if the answer is negative, the processing is terminated. On the other hand, if the answer is affirmative, a sufficient time required for the serviceman to adjust the ATDC sensor for detecting the toner content percentage of the developer is set to a timer and the function state is set to "3" (steps F137 and F138), and the processing is terminated.

FIG. 24 is a flowchart of functions states 3 and 4. When the routine transfers to this routine in state "3", a check is made as to whether the lamp ON timer which was set in step F134 of state "2" or the ATDC sensor adjustment timer which was set in step F137 is timed out or not (step F141) and if the answer is negative, the processing is terminated. On the other hand, if the answer is affirmative, the main charger and the exposure lamp are turned OFF, the auto-shut state is set to "1" to start auto-shut operation or auto-end operation and the function state is set to "0" (steps F142 to F145), and the processing is terminated. Where the routine transfers to this routine in the function state "4", the steps F142 to F145 are executed and the processing terminated.

(8) Indication Flicker Processing Routine

Figure 25:
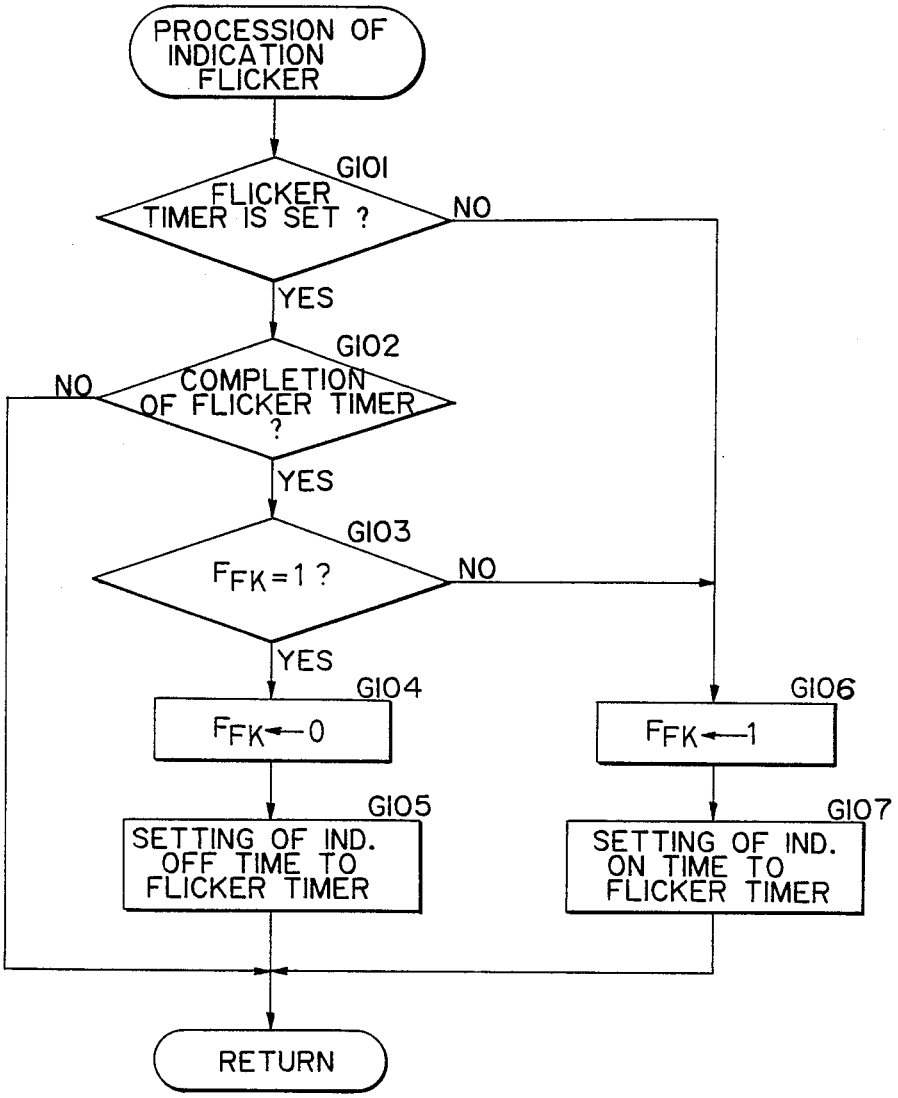

The indication flicker processing of step M9 in the flowchart of FIG. 8 will be explained in detail below with reference to the flowchart of FIG. 25.

In order to indicate the operation and end of the developer agitation necessary for the adjustment of the ATDC sensor which is executed in the function inspection processing explained above, and to indicate that the toner bottle of the developing unit not in use is empty, there is performed setting of a timer and a flag for flickering the indicating element of the said developing unit.

First, a check is made as to whether the flicker timer is set or not (step G101) and if the answer is affirmative, a check is made as to whether the flicker timer which is set in steps G105 and G107 is timed out or not (step G102). If the answer is affirmative, a check is made using the indication flicker flag, designated $F_{FK}$, as to whether the indication mode is an indication ON mode for flickering the indicating element and if the answer is affirmative (flag $F_{FK}=1$), the flag $F_{FK}$ is reset to "0" for change-over to an indication OFF mode and an indication OFF time is set to the flicker timer (steps G103 to G105). On the other hand, in the indication OFF mode (flag $F_{FK}\neq 1$), the flag $F_{FK}$ is set to "1" for changeover to the indication ON mode and the indication ON time is set to the flicker timer (steps G103, G106 and G107), and the processing is terminated. When the flicker timer is not set in step G101, execution shifts to step G106 to newly enter the flicker processing. If the flicker timer is not timed out in step G102, the processing is terminated.

(9) Selected Developing Unit Indicating Processing Routine

Figure 26:
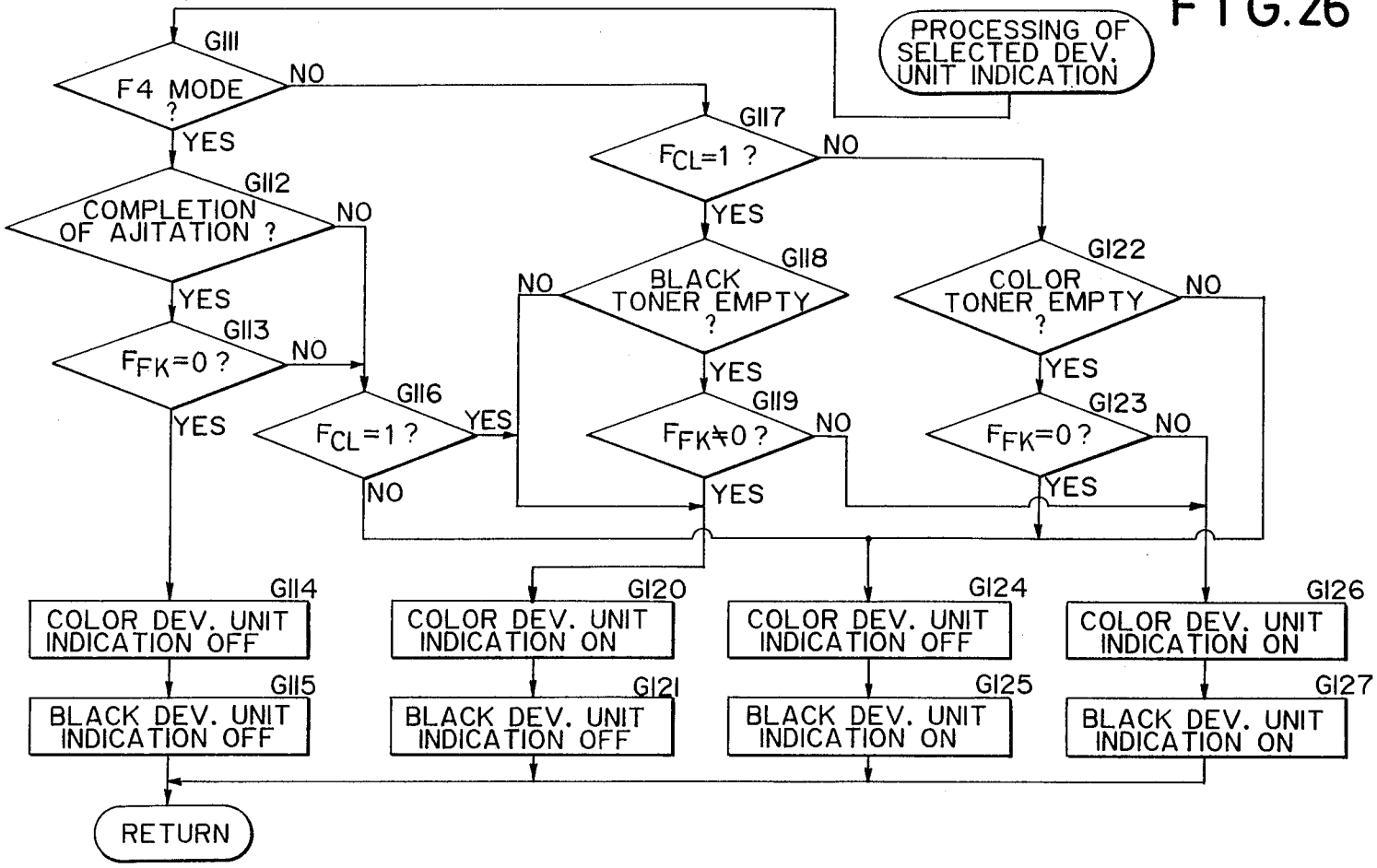

The selected developing unit indicating processing of step M10 in the flowchart of FIG. 9 will be explain in detail below with reference to the flowchart of FIG. 26.

This routine works together with the indication flicker processing routine explained above.

First, a check is made as to whether the test mode in the function inspection processing routine explained previously is F4 mode or not, that is, whether it is the ATDC sensor adjusting mode or not (step G111) and if the answer is affirmative, a check is made as to whether the agitation of the developer has not been completed yet (step G112). This check can utilize the result of step F136 in the function inspection processing routine in which a check was made as to whether the developer agitation timer was timed out or not. If the agitation has not been completed yet, a check is made as to whether the indication flicker flag $F_{FK}$ which is set and reset in the indication flicker processing routine is "0" or not (step G113) and if the answer is affirmative, the indicating units (122 and 123) of the color and black developing units are turned OFF (steps G114 and G115), and the processing is terminated.

When the agitation of the developer is judged to have been completed in step G112 and when the indication flicker flag $F_{FK}\neq 0$ in the judgment of step G113, the routine transfers to step G116 and a check is made as to whether the color developing unit is selected or not. If the answer is affirmative, the indicating element 122 of the color developing unit is turned ON, while the indicating element 123 of the black developing unit is turned OFF (steps G120 and G121). On the other hand, when the color developing unit is not selected, that is, the black developing unit is selected, the color side is turned OFF and the black side ON reversely to the above (steps G124 and G125). As a result, if the agitation of the developer has not been completed yet, the indicating element of either the color or black developing unit selected flickers according to the operation time of the ON-OFF time defining flicker timer which was set in the indication flicker processing routine. And after completion of the agitation, the indicating element lights continuously.

On the other hand, when the test mode is judged to be not F4 mode in step G111, that is, the operating condition is a normal condition, there is made indication of the selected developing unit, and when the toner supply bottle of the developing unit not selected has become empty, this condition is indicated. More specifically, execution shifts to step G117 to check which of the color and black developing units is now selected and if the color developing unit is selected, the routine transfers to step G118 to check with the empty sensor 60 whether the toner supply bottle of the black developing unit is empty or not. If it is not empty, the routine transfers to steps G120 and G121 to turn ON the indicating element 122 of the color developing unit, turn OFF the indicating element 123 of the black developing unit and indicate the selected color developing unit. On the other hand, when the toner supply bottle is empty, routine transfers to step G119 to judge whether the indication flicker flag $F_{FK}$ is "0" or not and if $F_{FK}\neq 0$, the routine transfers to steps G120 and G121 to turn ON the indicating element of the color developing unit and turn OFF the indicating element of the black developing unit. When, $F_{FK}=0$, the routine transfers to steps G126 and G127, and both the color and black side indicating elements are turned ON. In this case, therefore, the color-side indicating element lights continuously, while the black-side indicating element flickers, to indicate that the color developing unit is selected and that the toner supply bottle of the black developing unit not selected is empty.

If in step G117 the developing unit selected is not the color developing unit, that is, the black developing unit is selected, the routine transfers to step G122 to check with the empty sensor 46 whether the toner supply bottle of the color developing unit is empty or not and if the answer is negative, the routine transfers to steps G124 and G125 to turn OFF the indicating element 122 of the color developing unit and turn ON the indicating element 123 of the black developing unit, indicating the black developing unit to be selected. When the toner supply bottle is empty, the routine transfers to step G123 to judge whether the indication flicker flag $F_{FK}$ is "0" or not and if the answer is affirmative, the routine transfers to steps G124 and G125 to turn OFF the indicating element of the color developing unit and turn ON the indicating element of the black developing unit. On the other hand, if $F_{FK}\neq 0$, the routine transfers to steps G126 and G127 to turn ON both the color and black side indicating elements. In this case, reversely to the previous case, the black-side indicating elements lights continuously, while the color-side indicating element flickers, to indicate that the black developing unit is selected and that the toner supply bottle of the color developing unit not selected is empty.

(10) Magnetic Brush Removing Processing Routine

Figure 27:
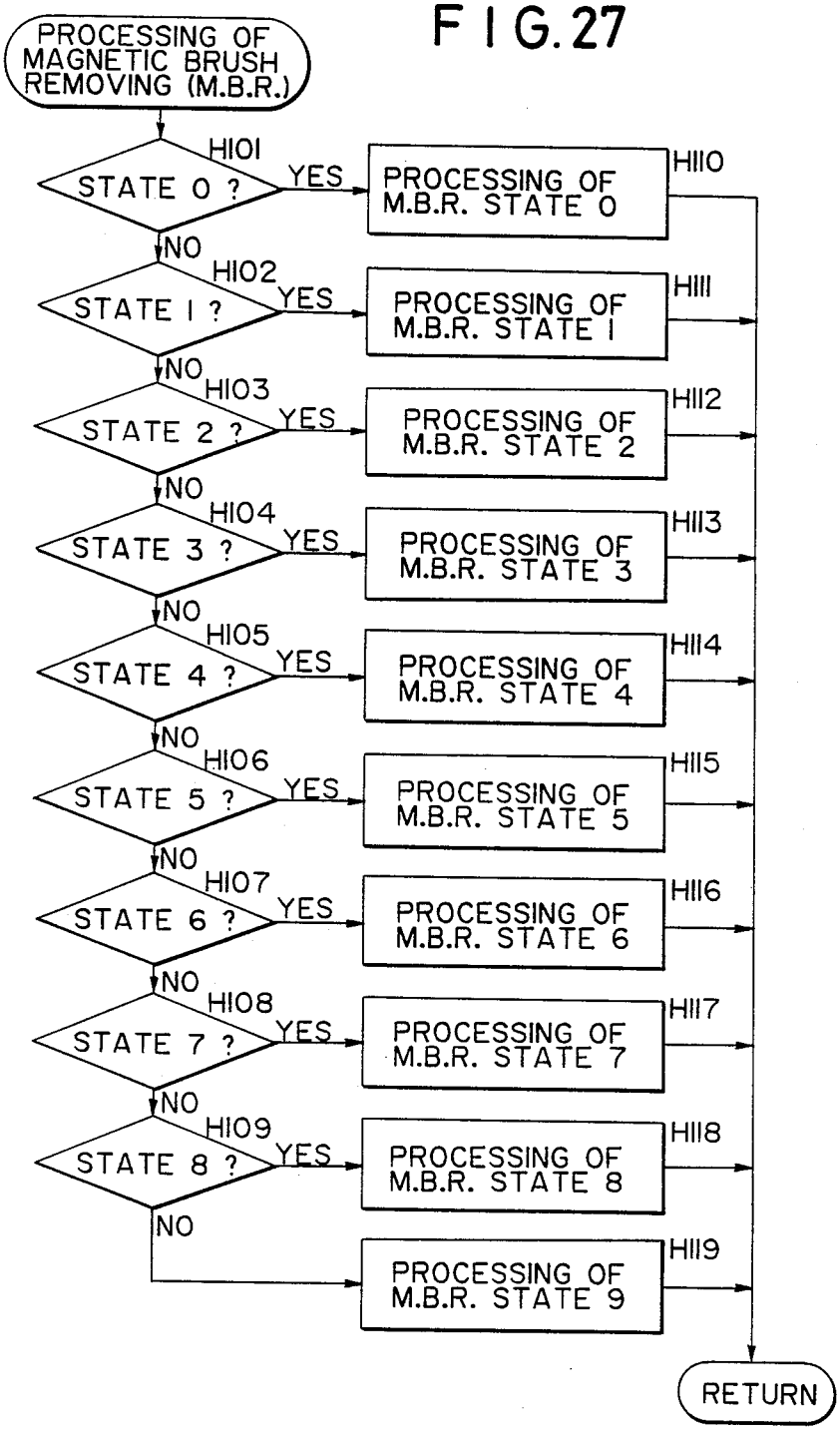

The magnetic brush removing processing of step M12 in the flowchart of FIG. 8 will be explained in detail below with reference to the flowcharts of FIGS. 27 to 37. FIG. 27 shows subroutine processings from state "0" to state "9" which are adopted in the magnetic brush removing routine. State numbers are set to the subroutines (steps H101 to H109) and the routine transfers to the corresponding subroutines (steps H110 to H119) to effect processings.

Figure 28:
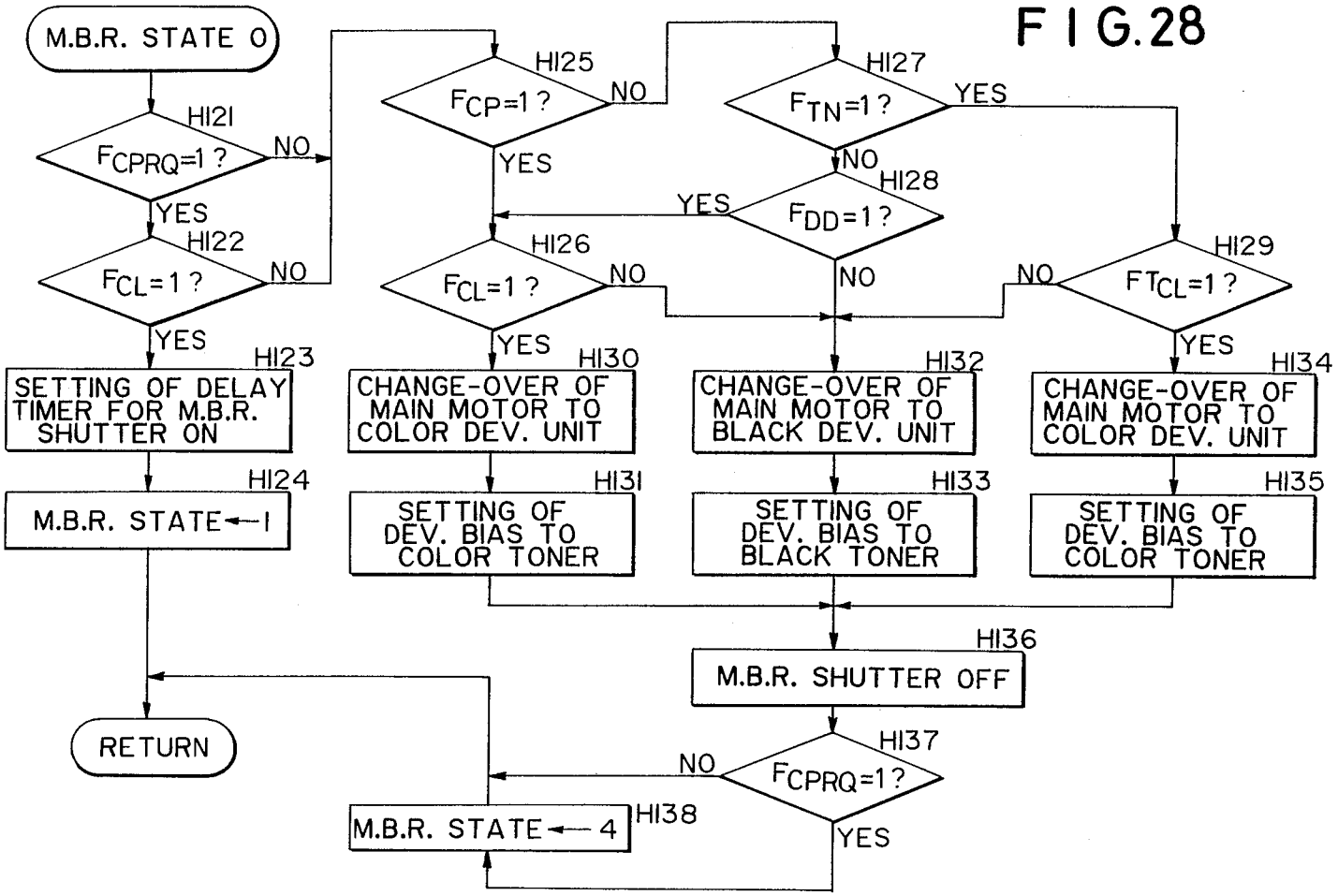

FIG. 28 is a flowchart of magnetic brush removing state "0", showing a processing concerned with preparations for operation of the developing units. A check is made as to whether a flag $F_{CPRQ}$, which indicates a request for copy start and which is set upon depression of the print button on the operating panel, is "1" or not (step H121). If the answer is affirmative, that is, when there is a request for starting copying, a check is made as to whether the copying mode is the color copying mode or not (step H122) and if the answer is affirmative, a magnetic brush removing shutter ON delay timer is set so that the magnetic brush removing shutter 73 operates when the copying operation is started and the rotation of the main motor rises to a normal rotation speed, then the magnetic brush removing state is set to "1" (steps H123 and H124), and the processing is terminated. When there is not request for starting copy in step H121 and when the copying mode is not the color copying mode in step H122, the routine transfers to step H125 to check whether the flag $F_{CP}$ indicating that copying operation is being performed, is "1" or not, and if the answer is affirmative, the routine transfers to step H126 to check whether the copying mode is the color copying mode or not, using the flag $F_{CL}$. If the answer is affirmative, there is made a change-over of the drive connection mechanism so that the power from the main motor is transmitted to the color developing unit, and the developing bias is set to the color toner level (steps H130 and H131). On the other hand, when the copying mode is not the color copying mode in step H126, there is made a change-over of the drive connection mechanism so that the power from the main motor is transmitted to the black developing unit, and the developing bias is set to the black toner level (steps H132 and H133).

When copying operation is not under way in step H125, the routine transfers to step H127 to check whether the flag $F_{TN}$ indicating that the toner supply mode is set, is "1" or not, and if $F_{TN} \neq 1$, that is, if the toner supply mode is not set, a check is made as to whether the flag $F_{DD}$ indicating that the drum dry mode is set, is "1" or not (step H128). If $F_{DD} \neq 1$, that is, if the drum dry mode is not set, routine transfers to steps H132 and H133, in which there is made a change-over of the drive connection mechanism so that the power from the main motor is transmitted to the black developing unit, and the developing bias is set to the black toner level.

When the drum dry mode is judged to be set in step H128, execution shifts to step H126.

When the toner supply mode is judged to be set in step H127, the routine transfers to step H129 to check whether the color toner supply mode is set or not, using a flag $FT_{TN}$, and if the answer is affirmative, there is made a change-over of the drive connection mechanism so that the power from the main motor is transmitted to the color developing unit, and the developing bias is set to the color toner level (H134 and H135). On the other hand, if the color toner supply mode is not set, the routine transfers to steps H132 and H133. In each of the color and black developing units, once there is made a change-over of the drive connection mechanism and the main motor is driven, the developing sleeve, the agitating bucket and the screw start rotation.

Thereafter, the routine transfers to step H136 to turn OFF or open the magnetic brush removing shutter and a check is made as to whether there is a request for starting copying, using the flag $F_{CPRQ}$. If the answer is affirmative, the magnetic brush removing state is set to "4" to inhibit the change-over of the developing sleeve which is performed in the routine of magnetic brush removing state "1", while if there is no request for copy, the processing is terminated (steps H137 and H138).

Figure 29:
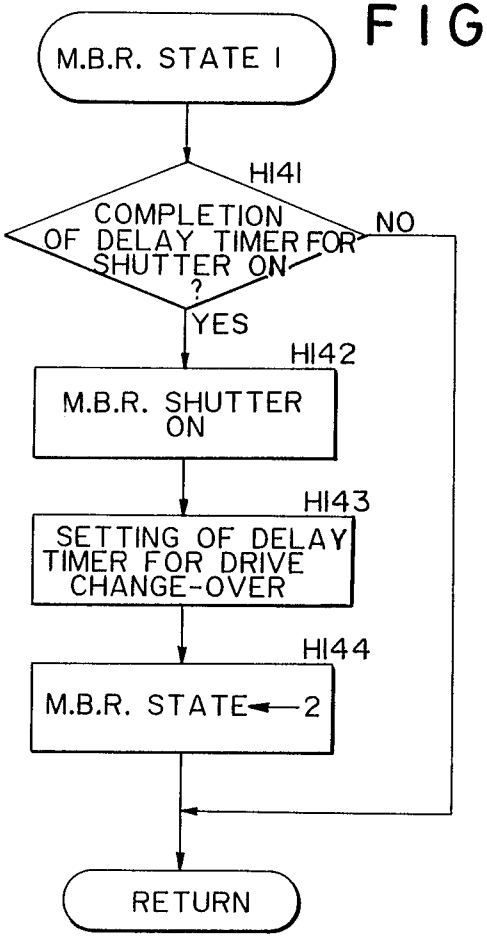

FIG. 29 is a flowchart of magnetic brush removing state "1", in which there is made a check as to whether the magnetic brush removing shutter ON delay timer which was set in step H123 or state "0" is timed out or not (step H141) and if the answer is negative, the processing is terminated. On the other hand, if the answer is affirmative, the magnetic brush removing shutter is turned ON or closed to remove the brushes of the black toner formed on the developing sleeve of the black developing unit which has so far been set (step H142), followed by change-over of the drive connection mechanism to drive the color developing unit. In this case, the delay timer is set to make a change-over upon completion of the magnetic brush removing operation after several rotations of the developing sleeve of the black developing unit (step H143), then the magnetic brush removing state is set to "2" (step H144) and the processing is terminated.

Figure 30:
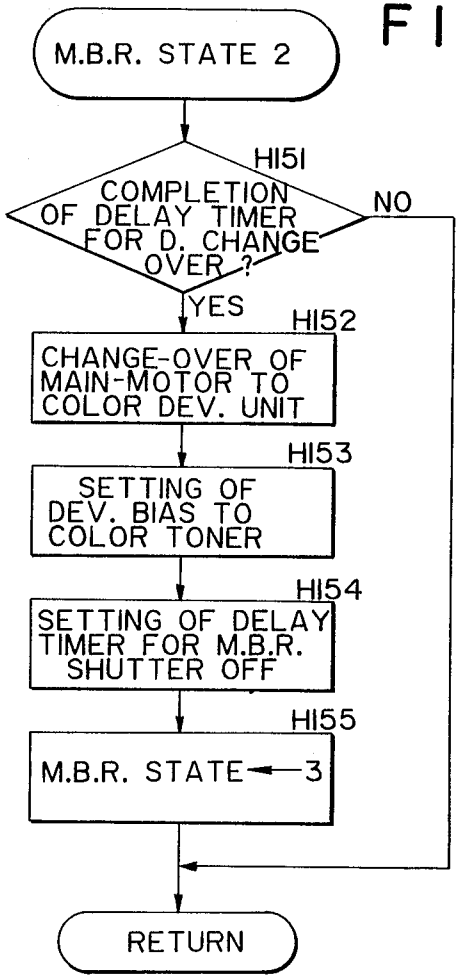

FIG. 30 is a flowchart of magnetic brush removing state "2", in which there is made a check as to whether the drive connection change-over delay timer which was set in step H143 of state "1" is timed out or not (step H151). If the answer is negative, the processing is terminated, while if the answer is affirmative, there is made a change-over of the drive connection mechanism to rotate the developing sleeve of the color developing unit and the developing bias is set to the color level (steps H152 and H153). After completion of the magnetic brush removing operation, the delay timer is set to turn OFF the magnetic brush removing shutter because it is no longer necessary to keep the shutter closed, then the magnetic brush removing state is set to "3" (steps H154 and H155) and the processing is terminated.

Figure 31:
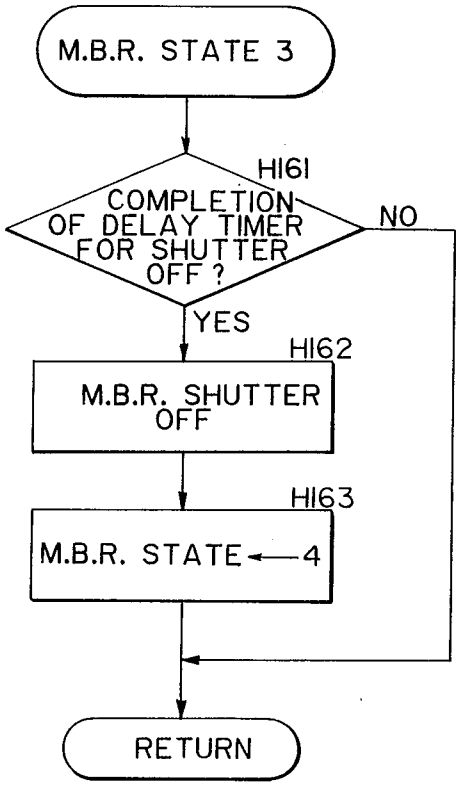

FIG. 31 is a flowchart of magnetic brush removing state "3, in which there is made a check as to whether the magnetic brush removing shutter OFF delay timer which was set in step H154 of state "2" is timed out or not (step H161). If the answer is negative, the processing is terminated, while if the answer is affirmative, the magnetic brush removing shutter is turned OFF and the magnetic brush removing state is set to "4" (steps H162 and H163), and the processing is terminated.

Figure 32:
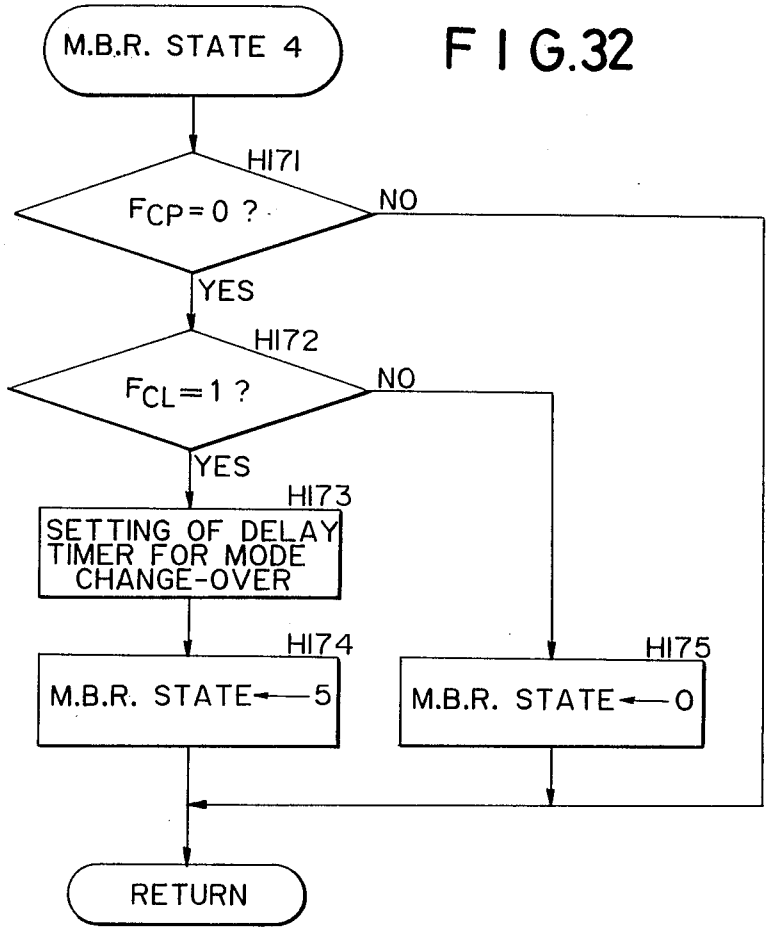

FIG. 32 is a flowchart of magnetic brush removing state "4. According to this processing, after the end of the color copying operation and after turning OFF of the main motor, the drive connection change-over to the black developing unit to be operated is delayed a predetermined time to prevent the formation of brushes on the developing sleeve of the black developing unit. A delay timer for delaying the permission of the change-over to the black copying mode is set.

First, a check is made using the flag $F_{CP}$ as to whether copying is over or not (step H171) and if the answer is negative, the processing is terminated, while if the answer is affirmative, a check is made using the flag $F_{CL}$ as to whether the copying mode was the color copying mode or not (step H172). If the answer is affirmative, the delay timer for delaying the permission of the change-over from the color copying mode to the black copying mode is set and the magnetic brush removing state is set to "5" (steps H173 and H174), and the processing is terminated. Where the copying mode was not the color copying mode in step H172, the routine transfers to step H175 to set the magnetic brush removing state to "0" because the processings of steps H173 and H175 are not necessary, and the processing is terminated.

Figure 33:
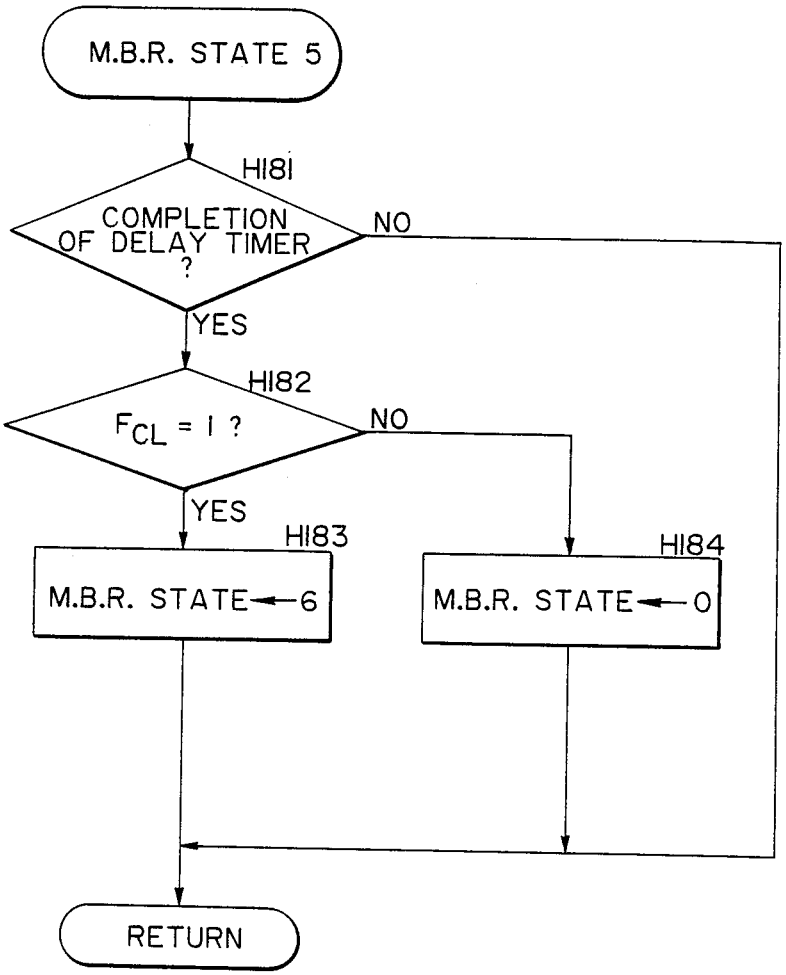

FIG. 33 is a flowchart of magnetic brush removing state "5". According to this routine, there is made a judgment as to whether the delay timer for delaying the change-over to the black copying mode which was set in step H173 of magnetic brush removing state "4" is timed out or not.

First, in step H181 there is made a check as to whether the mode change-over permission delay timer set previously is timed out or not and if the answer is negative, the processing is terminated, while if the answer is affirmative, a check is made using the flag $F_{CL}$ as to whether the copying mode is the color copying mode or not. If the color copying mode is under way, the magnetic brush removing state is set to "6", while if the answer is negative, the magnetic brush removing state is set to "0" (steps H182 to H184), and the processing is terminated.

Figure 34:
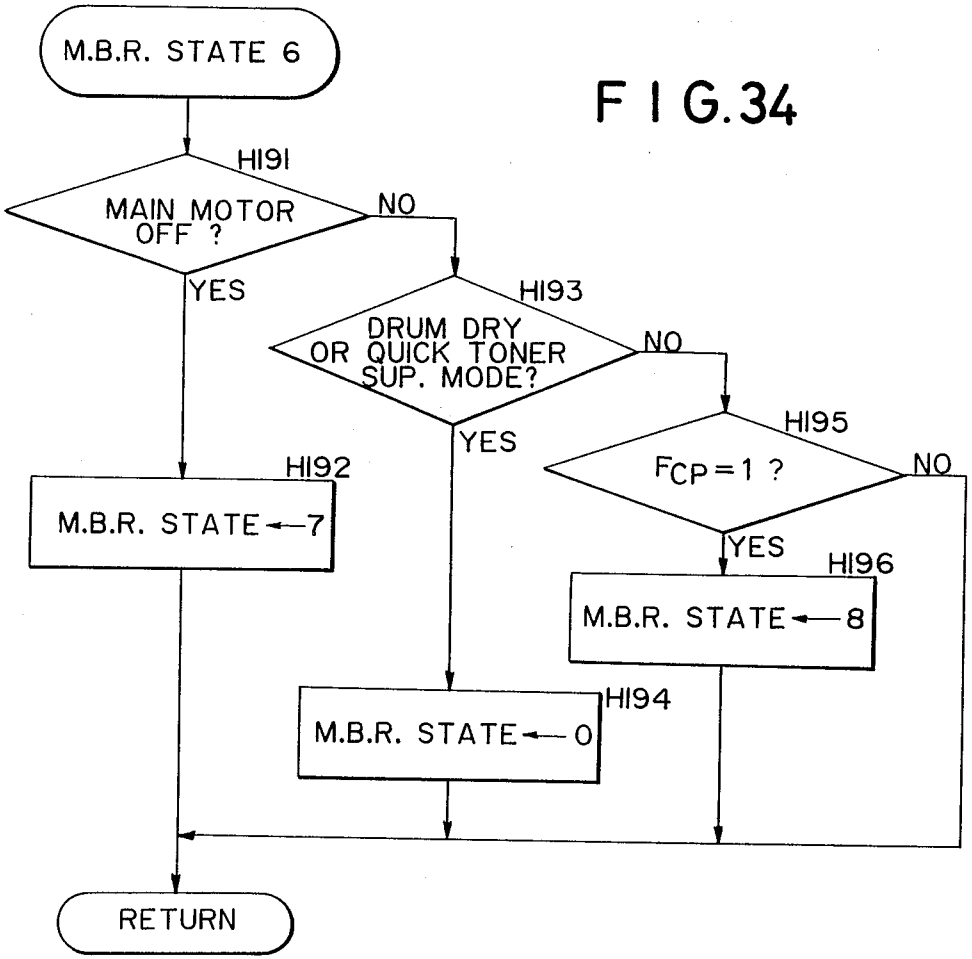

FIG. 34 is a flowchart of magnetic brush removing state "6". According to the routine, when the main motor is under rotation, drum dry or quick toner supply is started, the drive connection mechanism is changed over to the color developing unit to effect color copy, and the developing bias is set, while when upon turning OFF of the main motor, preparations for, change-over to the black copying mode are made, that is, state setting is performed.

First, a check is made as to whether the main motor is OFF or not (step H191) and if the answer is affirmative, the magnetic brush removing state is set to "7" (step H192) and the processing is terminated. On the other hand, when the main motor is not OFF, a check is made as to which of the drum dry mode or the quick toner supply mode is set (step H193). If either of the modes is set, the magnetic brush removing state is set to "0" (step H194) and the processing is terminated. If neither of the modes is set in step H193, a check is made using the flag $F_{CP}$ as to whether copying operation is again under way or not. And if the answer is affirmative, the magnetic brush removing state is set to "8", while if the answer is negative, the processing is terminated (steps H195 and H196).

Figure 35:
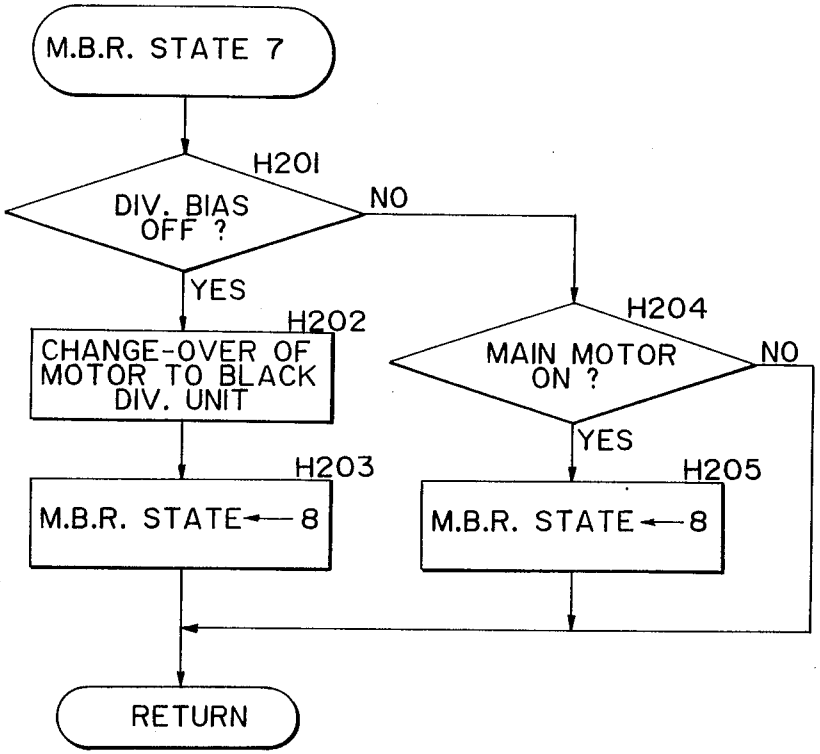

FIG. 35 is a flowchart of magnetic brush removing state "7". First, a check is made as to whether the developing bias is OFF or not (step H201) and if the answer is affirmative, it follows that the main motor is completely OFF and the rotation of the photosensitive drum has stopped, so the drive connection mechanism is changed over to the black copying mode for rotating the developing sleeve of the black developing unit to prepare for black copy, then the magnetic brush removing state is set to "8" (steps H202 and H203) and the processing is terminated. On the other hand, when the developing bias is not OFF in step H201, a check is made as to whether the main motor has again turned ON or not, and if the answer is negative, the processing is terminated, while if the answer is affirmative, the magnetic brush removing state is set to "8" (steps H204 and H205) and the processing is terminated.

Figure 36:
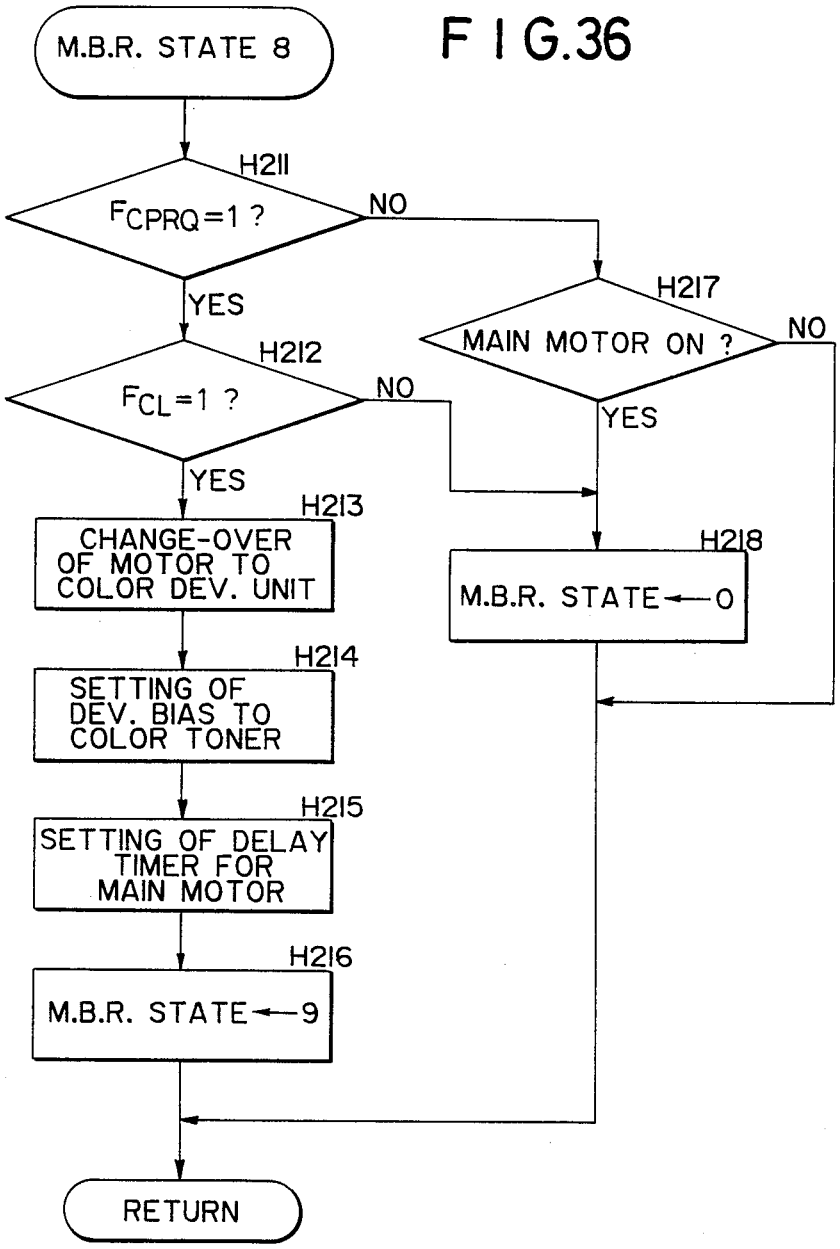

FIG. 36 is a flowchart of magnetic brush removing state "8". A check is made using the flag $F_{CPRQ}$ as to whether there was a request for starting copying in step H211 and if the answer is affirmative, a check is made using the flag $F_{CL}$ as to whether the copying mode is the color copying mode or not (step H212). If the answer is affirmative, the drive connection mechanism is changed over for rotating the developing sleeve of the color developing unit to prepare for color copy and the developing bias is set to the color level (steps H213 and H214). Further, in order to ensure the change-over of the drive connection mechanism, the delay timer for delaying the main motor ON time by a predetermined time is set and the magnetic brush removing state is set to "9" (steps H215 and H216) and the processing is terminated. It is when color copy is performed again after the end of color copying that this routine is executed, so the magnetic ,brush removing processing has already been completed, and is not newly performed.

If there is no request for starting copy in step H211, the routine transfers to step H217 to check whether the main motor is ON or not. If the answer is negative, the processing is terminated, while if the answer is affirmative, the magnetic brush removing state is set to "0" (steps H217 and H218) and the processing is terminated. Further, if the copying mode is not the color copying mode in step H212, the routine transfers to step H218 to set the magnetic brush removing state to "0".

Figure 37:
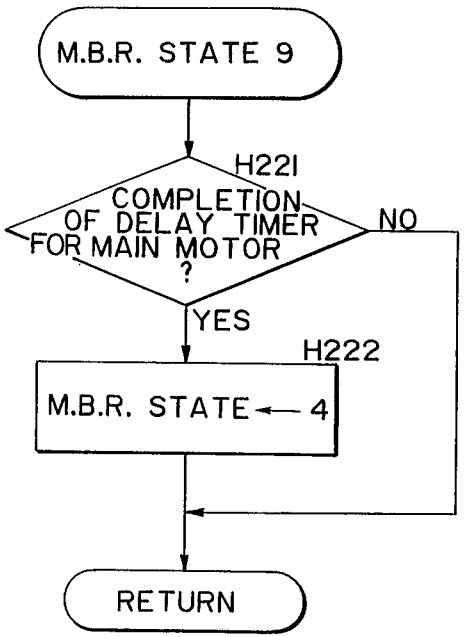

FIG. 37 is a flowchart of magnetic brush removing state "9". A check is made as to whether the main motor delay timer which was set in step H215 of magnetic brush removing state "8" is timed out or not and if the answer is affirmative, the magnetic brush removing state is set to "4", while if the answer is negative, the processing is terminated (steps H221 and H222).

Having described our invention as related to the embodiment shown in the accompanying drawing, it is our intention that the invention be not limited by any of the details of description, unless otherwise specified, but rather be construed broadly within its spirit and scope as set out in the accompanying claims.

What is claimed is:

1. A copying machine having plural developing means, said copying machine including:
   - a photosensitive medium;
   - said plural developing means for developing a latent image formed on the photosensitive medium, using a toner;
   - plural toner supply means provided in corresponding relation to the plural developing means;
   - selecting means for selecting one of the plural developing means;
   - means for detecting a residual quantity of the toner of each said toner supply means;
   - a plurality of indicating elements each corresponding to a specified developing means; and
   - control means which, when any of the developing means is selected by said selecting means, lights in a first state one of said indicating elements corresponding to the selected developing means and which, when it is detected by said residual toner quantity detecting means that the residual quantity of the toner of the toner supply means corresponding to unselected developing means is below a predetermined value, lights one of said indicating elements corresponding to the unselected developing means in a second state different from the first state.

2. A copying machine according to claim 1, wherein the first state of lighting of the indicating element is continuous lighting, while the second state of lighting is flicker.

3. A copying machine having plural developing means, said copying machine including:
   - a photosensitive medium;
   - first developing means for developing a latent image formed on the photosensitive medium, using a first color of toner;
   - first toner supply means for supplying the first color of toner to the first developing means;
   - second developing means for developing a latent image formed on the photosensitive medium, using a second color of toner;
   - second toner supply means for supplying the second color of toner to the second developing means;
   - mode selecting means for selecting either a first mode of forming a copy image with the first color of toner or a second mode of forming a copy image with the second color of toner;

single manual operation switch which inputs a toner supply instruction;

first control means which, when the first mode is selected, turns ON the first toner supply means in response to the toner supply instruction and turns OFF the second toner supply means; and second control means which, when the second mode is selected, turns ON the second toner supply means in response to the toner supply instruction and turns OFF the first toner supply means.

4. A copying machine according to claim 3, further including:

third control means which discontinues the controlling operation of the first control means when the second mode is selected by the mode selecting means during execution of the controlling operation of the first control means.

5. A copying machine according to claim 4, further including:

fourth control means which, after the end of the copying operation in the second mode, restarts the controlling operation of the first control means which has been discontinued.

6. A copying machine according to claim 3, further including:

third control means which discontinues the controlling operation of the second control means when the first mode is selected by the mode selecting means during execution of the controlling operation of the second control means.

7. A copying machine according to claim 6, further including:

fourth control means which, after the end of the copying operation in the first mode, restarts the controlling operation of the second control means which has been discontinued.

8. A copying machine having plural developing means, said copying machine including:

a photosensitive medium;

first developing means for developing a latent image formed on the photosensitive medium, using a first color of toner;

first toner supply means for supplying the first color of toner to the first developing means;

first detecting means for detecting the lack of toner in the first toner supply means;

second developing means for developing a latent image formed on the photosensitive medium, using a second color of toner;

second toner supply means for supplying the second color of toner to the second developing means;

second detecting means for detecting the lack of toner in the second toner supply means;

mode selecting means for selecting either a first mode of forming a copy image with the first color of toner or a second mode of forming a copy image with the second color of toner;

indicating means comprising first and second indicating elements each having first and second indicating modes, respectively;

first indication control means which drives the first indicating element in the first indicating mode when the copying mode is the first mode and which drives the second indicating element in the first indicating mode when the copying mode is the second mode; and second indication control means which drives the second indicating element in the second indicating mode in response to the second detecting means when the copying mode is the first mode and which drives the first indicating element in the second indicating mode in response to the first detecting means when the copying mode is the second mode.

9. A copying machine according to claim 8, wherein the first indicating mode is continuous lighting of the indicating elements and the second indicating mode is flickering of the indicating elements.

10. A copying machine having plural developing means, said copying machine including:

a photosensitive medium;

plural developing means for developing a latent image formed on the photosensitive medium;

state changing means for setting each said developing means to an operative state or an inoperative state;

means for selecting one of the plural developing means;

copying instruction inputting means;

means for controlling said state changing means in response to the copying instruction so as to render the developing means selected by the selecting means operative and the other developing means inoperative;

means for outputting an end signal when the change of state is completed by said state changing means; and control means for starting the copying operation in response to said end signal.

* * * * *